US005717973A

United States Patent [19]

Endoh et al.

[11] Patent Number: 5,717,973

[45] Date of Patent: Feb. 10, 1998

[54] IMAGE-FORMING MACHINE WITH TONER RECYCLING AND TONER REPLENISH CONTROL

[75] Inventors: Hirohisa Endoh; Kohji Shin; Tetsuro Kawashima, all of Osaka, Japan

[73] Assignee: Mita Industrial Co., Ltd., Osaka, Japan

[21] Appl. No.: 370,439

[22] Filed: Jan. 9, 1995

[30] Foreign Application Priority Data

| | | | |
|---|---|---|---|
| Jan. 14, 1994 | [JP] | Japan | 6-002496 |
| Jan. 14, 1994 | [JP] | Japan | 6-002497 |
| Jan. 17, 1994 | [JP] | Japan | 6-003126 |
| Jan. 17, 1994 | [JP] | Japan | 6-003127 |
| Jan. 17, 1994 | [JP] | Japan | 6-003128 |
| Jan. 17, 1994 | [JP] | Japan | 6-003129 |
| Jan. 17, 1994 | [JP] | Japan | 6-003130 |
| Jan. 17, 1994 | [JP] | Japan | 6-003131 |
| Mar. 14, 1994 | [JP] | Japan | 6-042382 |

[51] Int. Cl.[6] ..... G03G 15/08; G03G 21/00

[52] U.S. Cl. ..... 399/29; 399/63; 399/105; 399/120

[58] Field of Search ..... 355/245, 246, 355/260, 298; 399/27, 29, 58, 61, 62, 63, 105, 120

[56] References Cited

U.S. PATENT DOCUMENTS

| | | | |
|---|---|---|---|
| 4,963,929 | 10/1990 | Ueda et al. | 355/246 X |
| 5,005,517 | 4/1991 | Fukui et al. | 355/246 X |
| 5,049,938 | 9/1991 | Ueda | 355/246 |
| 5,283,616 | 2/1994 | Numogami et al. | 355/245 |
| 5,493,382 | 2/1996 | Takagaki et al. | 355/298 |

FOREIGN PATENT DOCUMENTS

| | | |
|---|---|---|
| 0 577 923 | 1/1994 | European Pat. Off. . |
| 2 265 993 | 10/1993 | United Kingdom . |

OTHER PUBLICATIONS

Abstract for Japanese Publication No. JP-A-59 128566.

Abstract for Japanese Publication No. JP-A-03 025470.

*Primary Examiner*—Fred L. Braun

*Attorney, Agent, or Firm*—Beveridge, DeGrandi, Weilacher & Young, L.L.P.

[57] ABSTRACT

An image-forming machine has a developing device that includes a developing agent container for containing a developing agent with toner and carrier particles, and a developing agent application device for applying the developing agent onto an image carrier device. The developing device also includes a toner replenishing device for replenishing the developing agent container with toner, a toner concentration detection device for detecting toner concentration of the developing agent, and a toner replenish control device. The toner replenish control device controls the toner replenishing device by comparing a value detected by the toner concentration detection device with a threshold value.

34 Claims, 8 Drawing Sheets

IMAGE-FORMING MACHINE WITH TONER RECYCLING AND TONER REPLENISH CONTROL

FIELD OF THE INVENTION

The present invention relates to an image-forming machine equipped with a developing means which develops an electrostatic latent image formed on an image carrier means into a toner image.

DESCRIPTION OF THE PRIOR ART

As image-forming machines such as a copying machine, a printing machine, a facsimile, etc., there is widely placed in practical use an image-forming machine of the type in which an electrostatic latent image is formed on an image carrier means, and the electrostatic latent image is developed into a toner image which is then transferred onto a sheet material. Such an image-forming machine further includes, in addition to the image carrier means, an electrostatic latent image-forming means for forming an electrostatic latent image on the image carrier means, a developing means for developing the electrostatic latent image on the image carrier means into a toner image, a transfer means for transferring the toner image on the image carrier means onto a sheet material, and a cleaning means for removing the toner that remains on the image carrier means after the toner image on the image carrier means has been transferred onto the sheet material. Furthermore, a toner recycling means has already been proposed and put into practical use to recycle the toner removed from the image carrier means by the cleaning means into the toner developing means. As for the image-forming machines equipped with the toner recycling means, reference should be made to, for example, Japanese Laid-Open Patent Publications Nos. 101979/1980, 8682/1988, 29776/1988 and U.S. Pat. No. 4,768,055.

The developing means generally includes a developing agent container for containing a developing agent that comprises toner and carrier particles, a developing agent application means for applying the developing agent in the developing agent container onto the image carrier means, a toner replenishing means for replenishing the developing agent container with the toner, a toner concentration detection means for detecting the toner concentration (ratio TW/DW of the weight TW of the toner to the weight DW of the developing agent) in the developing agent contained in the developing agent container, and a toner replenish control means for controlling the operation of the toner replenishing means. The toner replenish control means compares a value detected by the toner concentration detection means with a threshold value and controls the toner replenishing means. Usually, the toner concentration detection means is constituted by a magnetic permeability detector which produces the output voltage that varies depending upon the magnetic permeability of the developing agent, and the output voltage increases with a decrease in the toner concentration. The threshold value is a voltage. The toner replenishing means is placed under the inoperative condition when the value detected by the toner concentration detection means is larger than the toner concentration shown by the threshold value, i.e., when the output voltage of the magnetic permeability detector is not reaching the threshold value, whereas the toner replenishing means is placed under the operating condition when the toner concentration represented by a value detected by the toner concentration detection means becomes smaller than the toner concentration represented by the threshold value, i.e., when the output voltage of the magnetic permeability detector becomes greater than the threshold value.

When the toner recycling means is provided, the toner replenishing means includes a new toner container means which contains a new toner, a recycled toner receiving chamber for receiving the toner to be recycled by the toner recycling means, a toner mixing chamber for mixing the new toner fed from the new toner container means and the toner fed from the recycled toner receiving chamber, a recycled toner feeding means for feeding the recycled toner in the recycled toner receiving chamber into the mixing chamber, and a toner introduction means for introducing the toner in the mixing chamber into the developing agent container.

The toner introduction means of the toner replenishing means includes an electric motor for replenishing the toner. When the toner replenishing means is operated, the electric motor for replenishing the toner is repetitively energized for only a predetermined period of time at a predetermined time interval.

A conveyer/stirrer means is disposed in the developing container of the developing means. In a typical example, a circulation passage is defined in the developing agent container which is constituted by an upstream-side passage and a downstream-side passage that extend in parallel in the direction of width, the upstream-side passage and the downstream-side passage being communicated with each other at both ends thereof in the direction of width. The conveyer/stirrer means includes an upstream-side conveyer/stirrer mechanism disposed in the upstream-side passage and a downstream-side conveyer/stirrer mechanism disposed in the downstream-side passage. The upstream-side conveyer/stirrer mechanism is constituted by a rotary shaft that extends through the upstream-side passage in the direction of width and a spiral vane arranged on the peripheral surface of the rotary shaft. The downstream-side conveyer/stirrer mechanism is constituted by a rotary shaft that extends through the downstream-side passage in the direction of width and a spiral vane arranged on the peripheral surface of the rotary shaft. The developing agent application means in the developing means includes a sleeve member that extends along the downstream-side passage in the direction of width, draws up the developing agent that exists in the downstream-side passage in a developing agent drawing-up zone, and applies the developing agent to the electrostatic latent image on the image carrier means in a developing operation zone. There is further disposed a developing agent limiting member between the developing agent drawing-up zone and the developing operation zone to limit the amount of the developing agent held on the peripheral surface of the sleeve member. Stationary sealing members are disposed at both ends of the sleeve member and arcuately extend along the sleeve member.

The conventional image-forming machine, however, involves the following problems that must be solved.

First, in the image-forming machine equipped with the toner recycling means, the toner is recycled into the developing agent container as image formation is executed and the ratio of the recycled toner to the toner increases in the developing agent that exists in the developing agent container. According to experiment and consideration carried out by the present inventors, an increase in the ratio of the recycled toner to the toner in the developing agent held in the developing agent container brings about a change in the relationship between the value detected by the toner concentration detection means and the practical toner concentration (the practical toner concentration can be found by taking out the developing agent from the developing agent container to measure its weight and by separating the developing agent into the toner and the carrier particles to measure the weight of the toner). When the toner concentration detection means is constituted by the magnetic permeability detector which produces an output voltage that varies depending upon the magnetic permeability of the developing agent, an increase in the ratio of the recycled toner to the toner in the developing agent results in an increase in the output voltage of the magnetic permeability detector relative to a specific toner concentration (though the reason is not yet clear, it is assumed that the fluidity of the developing agent decreases with an increase in the ratio of the recycled toner to the toner in the developing agent since the recycled toner has largely been deformed and/or damaged, and consequently, the density of the developing agent increases causing a change in the magnetic permeability that is detected). In controlling the operation of the toner replenishing means based upon a predetermined threshold voltage, in other words, in the case where the toner replenishing means is placed under the inoperative condition when the output voltage of the magnetic permeability detector is smaller than the predetermined threshold voltage while it is placed under the operating condition when the output voltage of the magnetic permeability detector is larger than the predetermined threshold voltage, therefore, as the ratio of the recycled toner to the toner in the developing agent gradually increases with the execution of image formation, the practical toner concentration becomes excessively great in the developing agent. When the toner concentration becomes excessively great, the charging property of the toner becomes too small resulting in the occurrence of problems such as so-called fogging of the toner image, scattering of toner from the toner image and/or the developing means, etc. The occurrence of such problems is promoted further by the fact that the recycled toner has largely been deformed and/or damaged and as a result, usually has charging property smaller than that of the new toner.

Second, in the image-forming machine equipped with the toner recycling means, the recycled toner is usually not directly fed to the developing agent container. The recycled toner recycled by the recycling means into the recycled toner receiving chamber is fed into the mixing chamber while the new toner is fed into the mixing chamber from the new toner container means. The recycled toner and the new toner are then mixed together in the mixing chamber and thereafter, the mixed toner is fed into the developing agent container. In the conventional image-forming machine, however, the recycled toner and the new toner are not mixed together sufficiently and favorably in the mixing chamber but are introduced into the developing agent container in the form of separate layers.

Third, in the image-forming machine equipped with the toner recycling means, the recycled toner to be recycled by the recycling means is first received by the recycled toner receiving means in the toner replenishing means. However, the present inventors are empirically aware of the fact that the recycled toner overflows out of the recycled toner receiving chamber in case the recycled toner is recycled at one time and in large amounts such as when a large amount of residual toner is removed from the image carrier means by the cleaning means as a result of consecutively copying many pieces of small documents using a conventional image-forming machine such as a copying machine with its document cover being opened or when the recycled toner is caused to abruptly move due to physical impact given to the cleaning means as a result of treating the jamming of sheet materials.

Fourth, in the developing means including the toner concentration detection means for detecting the toner concentration in the developing agent container, toner replenishing means and toner replenish control means, the toner replenishing means is placed under the inoperative condition when the toner concentration shown by the value detected by the toner concentration detection means is larger than the toner concentration shown by the threshold value, whereas it is placed under the operating condition when the toner concentration shown by the value detected by the toner concentration detection means becomes smaller than the toner concentration shown by the threshold value as described above. And, as the toner replenishing means is placed under the operating condition, the electric motor for replenishing the toner provided in the toner replenishing means is repetitively energized for only a predetermined period of time at a predetermined time interval. When the value detected by the toner concentration detection means becomes smaller than a predetermined lower-limit toner concentration which is lower than the above-mentioned threshold value as a result of consecutively developing images having very large solid-black areas many times, the execution of the step of image formation is inhibited and the electric motor for replenishing the toner of the toner replenishing means is continuously energized for a relatively long period of time. Then, when the toner concentration shown by the value detected by the toner concentration detection means becomes larger than the threshold value, the normal control operation is resumed based upon the threshold value. When the toner concentration shown by the value detected by the toner concentration detection means is smaller than the threshold value, a toner depletion signal is produced to indicate that the toner is depleted in the toner replenishing means. However, when the value detected by the toner concentration detection means once becomes smaller than the above-mentioned lower-limit toner concentration despite the toner is present in sufficient amounts in the toner replenishing means, the electric motor for replenishing the toner in the toner replenishing means must be continuously energized for a relatively long period of time in order that the value detected by the toner concentration detection means is restored to a state in excess of the threshold value. Therefore, execution of the image-forming step is inhibited for a relatively long period of time.

Fifth, in a typical example of the developing means as described above, a circulation passage is defined in the developing agent container being constituted by an upstream-side passage and a downstream-side passage that extend in parallel in the direction of width, the upstream-side passage and the downstream-side passage being communicated to each other at both ends thereof in the direction of width. An upstream-side conveyer/stirrer mechanism is disposed in the upstream-side passage and a downstream-side conveyer/stirrer mechanism is disposed in the downstream-side passage. In the circulation passage in the developing agent container in the developing means, it is important that the developing agent is sufficiently stirred in the upstream-side passage, and the toner and the carrier particles are mixed together sufficiently uniformly so that the toner is electrically charged to a sufficient degree, in addition to that the developing agent is conveyed very favorably through the upstream-side passage and the downstream-side passage. It is further important that in the downstream-side passage, in particular, the developing agent is distributed sufficiently uniformly over the whole downstream-side passage. As the developing agent is nonuniformly distributed in the downstream-side passage, the developing agent is nonuniformly drawn up in the direction of width by the developing agent application means causing the nonuniform developing. In the conventional image-forming machine, however, the above-mentioned requirements could not be satisfied to a sufficient degree in the upstream-side passage and/or in the downstream-side passage of the circulation passage.

Sixth, in a typical example of the developing means as described above, the developing agent application means includes a sleeve member that extends in the direction of width, the developing agent is drawn up onto the peripheral surface of the sleeve member in the developing agent scooping zone, and the developing agent is applied onto the electrostatic latent image on the image carrier means in the developing operation zone. A developing agent limiting member is disposed between the developing agent drawing-up zone and the developing operation zone to limit the amount of the developing agent held on the peripheral surface of the sleeve member. In the conventional image-forming machine, however, when the developing agent is nonuniformly distributed in the direction of width in the developing agent drawing-up zone, it is not allowed to remedy such a nonuniformity to a sufficient degree by the action of the developing agent limiting member alone and, hence, the image is developed nonuniformly.

Seventh, in a typical example of the developing means as described above, the developing agent application means includes a sleeve member and at both ends of the sleeve member are disposed stationary sealing members that arcuately extend along the sleeve member. While the sleeve member is rotated in a predetermined direction, the developing agent held on the peripheral surface of the sleeve member in a region where the sealing members exist is sufficiently prevented from outwardly moving in the direction of width beyond the sealing members. In the regions where the sealing members do not exist (regions from the downstream end edge to the upstream end edge of the sealing members as viewed in a direction in which the sleeve members rotate), however, the developing agent held on the peripheral surface of the sleeve member may outwardly flow in the direction of width at both ends of the sleeve members. The developing agent that outwardly flows in the direction of width beyond the inner edges of the sealing members in the direction of width comes into contact with the upstream end edges of the sealing members and is prevented from moving with the rotation of the sleeve members, and often flows out to the periphery from the developing agent container.

SUMMARY OF THE INVENTION

A first object of the present invention is to provide an image-forming machine equipped with a toner recycling means which suitably prevents the toner concentration in the developing agent from becoming excessively high by properly compensating a change in the relationship between a value detected by a toner concentration detection means and a practical toner concentration caused by an increase in the ratio of the recycled toner to the toner in the developing agent held in the developing agent container as the image formation is executed.

A second object of the present invention is to provide an image-forming machine equipped with a toner recycling means in which the toner recycled into a recycled toner receiving chamber by a toner recycling means is mixed with a new toner in a mixing chamber to a sufficient degree, and the mixed toner is fed to the developing agent container.

A third object of the present invention is to provide an image-forming machine equipped with a toner recycling means which reliably prevents the recycled toner from overflowing out of the recycled toner receiving chamber without the need of greatly increasing the capacity of the recycled toner receiving chamber that receives the toner recycled by the toner recycling means.

A fourth object of the present invention is to provide an image-forming machine of a form in which when the toner concentration detected by a toner concentration detection means that detects the toner concentration of the developing agent in the developing agent container becomes smaller than a lower-limit toner concentration, the execution of the image-forming step is inhibited and an electric motor for replenishing the toner in a toner replenishing means is continuously energized, wherein the time for inhibiting the execution of the image-forming step and for continuously energizing the electric motor for replenishing the toner in the toner replenishing means is set to be shorter than the time required so far without arousing any problem.

A fifth object of the present invention is to provide an image-forming machine of a form in which a circulation passage is defined in the developing agent container constituted by an upstream-side passage and a downstream-side passage extending in parallel in the direction of width, the upstream-side passage and the downstream-side passage being communicated with each other at both ends thereof in the direction of width, an upstream-side conveyer/stirrer mechanism is disposed in the upstream-side passage and a downstream-side conveyer/stirrer mechanism is disposed in the downstream-side passage, wherein in addition to that the developing agent is very favorably conveyed through the upstream-side passage and the downstream-side passage, the developing agent is stirred in the upstream-side passage to such a degree that the toner and the carrier particles are very uniformly mixed together and that the toner can be electrically charged to a sufficient degree, and/or the developing agent is sufficiently uniformly distributed over the whole downstream-side passage.

A sixth object of the present invention is to provide an image-forming machine of a form in which a developing agent application means includes a sleeve member that extends in the direction of width, the developing agent is drawn up onto the peripheral surface of the sleeve member in a developing agent drawing-up zone, the developing agent is applied to an electrostatic latent image on an image carrier means in a developing operation zone, and a developing agent limiting member is disposed between the developing agent drawing-up zone and the developing operation zone to limit the amount of the developing agent held on the peripheral surface of the sleeve member, wherein even when the developing agent is nonuniformly distributed to some extent in the direction of width in the developing agent drawing-up zone, such a nonuniformity is remedied to a sufficient degree.

A seventh object of the present invention is to provide an image-forming machine of a form in which the developing agent application means includes a sleeve member, and at both ends of the sleeve member are disposed stationary sealing members that arcuately extend along the sleeve member, wherein even the developing agent held on the peripheral surface of the sleeve member that happens to flow toward the outside in the direction of width from both ends of the sleeve member in the regions where no sealing member exists, is reliably prevented from flowing out to the periphery from the developing agent container.

In order to accomplish the above-mentioned first object according to a first aspect of the present invention, there is provided an image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, a cleaning means for removing the toner remaining on said image carrier means after the toner image on said image carrier means has been transferred onto the sheet material, and a toner recycling means for recycling the toner removed from said image carrier means by said cleaning means into said developing means, wherein said developing means includes a developing agent container for containing a developing agent that comprises the toner and carrier particles, a developing agent application means for applying the developing agent in said developing agent container onto said image carrier means, a toner replenishing means for replenishing said developing agent container with the toner, a toner concentration detection means for detecting the toner concentration of the developing agent contained in said developing agent container, and a toner replenish control means for controlling the operation of said toner replenishing means by comparing a value detected by said toner concentration detection means with a threshold value, which is characterized in that said toner replenish control means changes said threshold value with the execution of image formation.

Preferably, the toner concentration detection means is constituted by a magnetic permeability detector which produces an output voltage that varies depending upon the magnetic permeability of the developing agent in the developing agent container, the output voltage of said toner concentration detection means increases with a decrease in the toner concentration of the developing agent in said developing agent container, said threshold value is a voltage, said toner replenish control means renders said toner replenishing means to be inoperative when the output voltage of said toner concentration detection means is smaller than said threshold value and renders said toner replenishing means to be operative when the output voltage of said toner concentration detection means exceeds said threshold value, and said toner replenish control means increases said threshold value with the execution of image formation.

According to a preferred embodiment, said image carrier means is constituted by an image carrier member that moves through an endless passage passing through a transfer zone and a cleaning zone, an electric motor is disposed to move said image carrier member, and said toner replenish control means maintains said threshold value constant until the cumulative operation time of said electric motor exceeds a predetermined period of time and, when the cumulative operation time of said electric motor exceeds the predetermined period of time, increases said threshold value in proportion to an increase in the cumulative operation time of said electric motor. Or, said toner replenish control means maintains said threshold value constant until the number of pieces of the sheet materials onto which is transferred the toner image on said image carrier means exceeds a predetermined number of pieces and, when the number of pieces of the sheet materials onto which is transferred the toner image on said image carrier means exceeds the predetermined number of pieces, increases said threshold value in proportion to an increase in the number of pieces.

In order to accomplish the above-mentioned second object according to a second aspect of the present invention, there is provided an image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, a cleaning means for removing the toner remaining on said image carrier means after the toner image on said image carrier means has been transferred onto the sheet material, and a toner recycling means for recycling the toner removed from said image carrier means by said cleaning means into said developing means, wherein said developing means includes a developing agent container for containing a developing agent that comprises the toner and carrier particles, a developing agent application means for applying the developing agent in said developing agent container onto said image carrier means, a toner replenishing means for replenishing said developing agent container with the toner, a toner concentration detection means for detecting the toner concentration of the developing agent contained in said developing agent container, and a toner replenish control means for controlling the operation of said toner replenishing means by comparing a value detected by said toner concentration detection means with a threshold value, and said toner replenishing means includes a new toner container means for containing a new toner, a recycled toner receiving chamber for receiving the toner recycled by said toner recycling means, a toner mixing chamber for mixing the new toner fed from said new toner receiving means and the toner fed from said recycled toner receiving chamber, a recycled toner feeding means for feeding the recycled toner in said recycled toner receiving chamber to said mixing chamber, and a toner introduction means for introducing the toner in said mixing chamber into said developing agent container, which is characterized in that said mixing chamber has its upper surface, one side surface and front surface thereof opened;

said new toner container means is disposed over said mixing chamber and has a discharge port communicated with the upper open surface of said mixing chamber, so that the new toner in said new toner container means is permitted to fall on said mixing chamber through said discharge port;

said recycled toner feeding means feeds the recycled toner into said mixing chamber via said open one side surface of said mixing chamber; and said toner introduction means conveys the toner from said mixing chamber and introduces it into said developing agent container via said open front surface of said mixing chamber.

Preferably, the recycled toner feeding means is constituted by a rotary shaft that extends along said open one side surface of said mixing chamber and paddling pieces disposed on the peripheral surface of said rotary shaft, said paddling pieces extending in the radial direction from the peripheral surface of said rotary shaft and further extending in the axial direction along the peripheral surface of said rotary shaft. The rotary shaft rotates in a direction in which front edges in the radial direction of said paddling pieces move from the lower position to the higher position on a side of said open one side surface of said mixing chamber.

In order to accomplish the above-mentioned third object according to a third aspect of the present invention, there is provided an image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, a cleaning means for removing the toner remaining on said image carrier means after the toner image on said image carrier means has been transferred onto the sheet material, and a toner recycling means for recycling the toner removed from said image carrier means by said cleaning means into said developing means, wherein said developing means includes a developing agent container for containing a developing agent that comprises the toner and carrier particles, a developing agent application means for applying the developing agent in said developing agent container onto said image carrier means, a toner replenishing means for replenishing said developing agent container with the toner, a toner concentration detection means for detecting the toner concentration of the developing agent contained in said developing agent container, and a toner replenish control means for controlling the operation of said toner replenishing means by comparing a value detected by said toner concentration detection means with a threshold value, and said toner replenishing means includes a new toner container means for containing a new toner, a recycled toner receiving chamber for receiving the toner recycled by said toner recycling means, a toner mixing chamber for mixing the new toner fed from said new toner receiving means and the toner fed from said recycled toner receiving chamber together, a recycled toner feeding means for feeding the recycled toner in said recycled toner receiving chamber to said mixing chamber, and a toner introduction means for introducing the toner in said mixing chamber into said developing agent container, which is characterized in that the capacity of said recycled toner receiving chamber is set to be about 20% of the capacity of said new toner container means.

In order to accomplish the above-mentioned fourth object according to a fourth aspect of the present invention, there is provided an image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto the sheet material, wherein said developing means includes a developing agent container for containing a developing agent that comprises the toner and carrier particles, a developing agent application means for applying the developing agent in said developing agent container onto said image carrier means, a toner replenishing means for replenishing said developing agent container with the toner, a toner concentration detection means for detecting the toner concentration of the developing agent contained in said developing agent container, and a toner replenish control means for controlling the operation of said toner replenishing means by comparing a value detected by said toner concentration detection means with a threshold value, and said toner replenishing means includes an electric motor for replenishing the toner so that when said electric motor for replenishing the toner is energized, said developing agent container is replenished with the toner;

said toner replenish control means renders said toner replenishing means to be inoperative when a value detected by said toner concentration detection means is larger than the toner concentration represented by said threshold value, renders said toner replenishing means to be operative when a value detected by said toner concentration detection means becomes smaller than the toner concentration represented by said threshold value, and repetitively operates said electric motor for replenishing the toner for only a normal feeding time T1 at a normal feeding interval T2 under the operating condition, which is characterized in that when the toner concentration represented by a value detected by said toner concentration detection means becomes smaller than a predetermined lower-limit toner concentration which is smaller than the toner concentration represented by said threshold value, said toner replenish control means continuously energizes the motor for replenishing the toner of said toner replenishing means for only a continuously feeding time T3 which is longer than said normal feeding time T1, and when the toner concentration represented by a value detected by said toner concentration detection means is in excess of a predetermined judging toner concentration which is smaller than the toner concentration represented by said threshold value but is larger than said lower-limit toner concentration value after the passage of said continuously feeding time T3, said toner replenish control means renders said toner replenishing means to be placed in a state of overfeeding operation and in this overfeeding operation state, said electric motor for feeding the toner is repetitively energized for only an overfeeding time T4 which is longer than said normal feeding time T1 but is shorter than said continuously feeding time T3 at an overfeeding interval T5.

Preferably, the overfeeding time T4 is about twice as long as the normal feeding time T1, the overfeeding interval T5 is nearly as long as the normal feeding interval T3, and the continuously feeding time T3 is more than 60 times as long as the normal feeding time T1.

In order to accomplish the above-mentioned fifth object according to a fifth aspect of the present invention, there is provided an image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto the sheet material, wherein said developing means includes a developing agent container for containing a developing agent that comprises the toner and carrier particles, a developing agent application means for applying the developing agent in said developing agent container onto said image carrier means, and a conveyer/stirrer means disposed in said developing agent container;

in said developing agent container is defined a circulation passage constituted by an upstream-side passage and a downstream-side passage that extend in parallel in the direction of width, said upstream-side passage and said downstream-side passage being communicated with each other at both ends thereof in the direction of width;

said conveyer/stirrer means includes an upstream-side conveyer/stirrer mechanism disposed in said upstream-side passage and a downstream-side conveyer/stirrer mechanism disposed in said downstream-side passage, said upstream-side conveyer/stirrer mechanism being constituted by a rotary shaft that extends through said upstream-side circulation passage in the direction of width and by a spiral vane disposed on the peripheral surface of said rotary shaft, and said downstream-side conveyer/stirrer mechanism being constituted by a rotary shaft that extends through said downstream-side circulation passage in the direction of width and by a spiral vane disposed on the peripheral surface of said rotary shaft; and said developing agent application means includes a sleeve member that extends along said downstream-side passage in the direction of width, and draws up the developing agent present in said downstream-side passage onto the peripheral surface of said sleeve member to apply it onto said image carrier means, which is characterized in that said downstream-side conveyer/stirrer mechanism includes a number of paddling pieces disposed on the peripheral surface of said rotary shaft at a distance in the peripheral direction, each of said paddling pieces extending in the radial direction from the peripheral surface of said rotary shaft and further extending in the axial direction across said spiral vane, and the front edges in the radial direction of said paddling pieces being located on the inside of the outer peripheral edges of said spiral vane in the radial direction; and/or said upstream-side conveyer/stirrer mechanism includes a number of paddling pieces disposed on the peripheral surface of said rotary shaft at a distance in the peripheral direction, each of said paddling pieces extending in the radial direction from the peripheral surface of said rotary shaft and further extending in the axial direction across said spiral vane, and the front edges in the radial direction of said paddling pieces being located on the inside of the outer peripheral edges of said spiral vane in the radial direction.

Preferably, the downstream-side conveyer/stirrer mechanism has the paddling pieces that are disposed substantially uniformly over substantially the whole developing operation region of said sleeve material, each of said paddling pieces continuously extending in the axial direction across said spiral vane. In the upstream-side conveyer/stirrer mechanism, it is preferred that no paddling piece exists in intermediate regions across the spiral vane in the axial direction in at least a portion of the rotary shaft. It is desired that the length from the peripheral surface of the rotary shaft to the front edge of said paddling pieces in the radial direction is nearly one half the length from the peripheral surface of the rotary shaft to the outer peripheral edge of the spiral vane in the radial direction. In a preferred embodiment, the developing means comprises a toner feeding means for feeding the toner into the developing agent container, said toner feeding means introduces the toner onto a side end portion in the direction of width of said upstream-side passage, said upstream-side conveyer/stirrer mechanism conveys the developing agent from said one end portion to the other end portion within said upstream-side passage, said downstream-side conveyer/stirrer mechanism conveys the developing agent within said downstream-side passage in a direction opposite to the direction in which the developing agent is conveyed in said upstream-side passage, and said upstream-side conveyer/stirrer mechanism has said paddling pieces that are disposed more densely on said one end portion thereof and on the vicinities thereof than on the other end portion and on the vicinities thereof.

In order to accomplish the above-mentioned sixth object according to a sixth aspect of the present invention, there is provided an image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto the sheet material, wherein said developing means includes a developing agent container for containing a developing agent that comprises the toner and carrier particles, a developing agent application means having a sleeve member for applying the developing agent in said developing agent container onto said image carrier means, and a developing agent limiting member;

said sleeve member is rotated in a predetermined direction to hold the developing agent in said developing agent container on the peripheral surface thereof in a developing agent drawing-up zone to carry it onto a developing operation zone, and said developing agent limiting member is positioned close to the peripheral surface of said sleeve member between said developing agent drawing-up zone and said developing operation zone in order to limit the amount of the developing agent held on the peripheral surface of said sleeve member, which is characterized in that a uniformalizing member is disposed on the upstream side of said developing agent limiting member as viewed in a direction in which said sleeve member rotates, said uniformalizing member having a working surface that gradually approaches the peripheral surface of said sleeve member toward the downstream side as viewed in a direction in which the sleeve member rotates, and a gap between the downstream end edge of said working surface of said uniformalizing member and the peripheral surface of said sleeve member being set to be larger than a gap between said developing agent limiting member and the peripheral surface of said sleeve member but smaller than the thickness of the layer of the developing agent held on the peripheral surface of said sleeve member in said developing agent drawing-up zone.

It is desired that the gap between said developing agent limiting member and the peripheral surface of said sleeve member is from 0.3 to 0.8 mm, the gap between the downstream end edge of the working surface of said uniformalizing member and the peripheral surface of said sleeve member is from 1.0 to 3.0 mm, and the working surface of said uniformalizing member extends being inclined at an angle of from 20 to 30 degrees with respect to a tangential line at a portion where the peripheral surface of said sleeve member is opposed to the downstream end edge of said uniformalizing member.

In order to accomplish the above-mentioned seventh object according to a seventh aspect of the present invention, there is provided an image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto the sheet material, wherein said developing means includes a developing agent container for containing a developing agent that comprises the toner and carrier particles, a developing agent application means having a sleeve member for applying the developing agent in said developing agent container onto said image carrier means, and stationary sealing members that arcuately extend at both ends of said sleeve member along said sleeve member, said sleeve member being rotated in a predetermined direction to hold the developing agent in said developing agent container on the peripheral surface thereof in a developing agent drawing-up zone and to convey it onto a developing operation zone, which is characterized in that at least inside portions in the direction of width at upstream end edges of said sealing members as viewed in a direction in which said sleeve member rotates are downwardly extending toward the inside in the direction of width.

In an image-forming machine provided according to the first aspect of the present invention, the toner concentration in the developing agent is prevented from becoming excessively great by compensating a change in the relationship between a value detected by a toner concentration detection means and a practical toner concentration by suitably changing the threshold value with which a value detected by the toner concentration detection means is compared despite of an increase in the ratio of the recycled toner to the toner in the developing agent in the developing agent container as a result of executing the image formation.

In the image-forming machine provided according to the second aspect of the present invention, a special constitution is employed in which the new toner is allowed to fall onto the mixing chamber through the open upper surface of the mixing chamber and the recycled toner is fed into the mixing chamber through the open side surface of the mixing chamber, so that the recycled toner and the new toner are favorably mixed together to a sufficient degree in the mixing chamber.

In the image-forming machine provided according to the third aspect of the present invention, the capacity of the recycled toner receiving chamber has been set to be about 20% of the capacity of the new toner container means which is a theoretical maximum capacity of the recycled toner received by the recycled toner receiving chamber. This makes it possible to decrease the capacity of the recycled toner receiving chamber to a minimum amount that is required, and hence to prevent the recycled toner from overflowing out of the recycled toner receiving chamber.

In the image-forming machine provided according to the fourth aspect of the present invention, the continuously feeding time T3 for continuously energizing the electric motor for replenishing the toner in the toner replenishing means is set not to a period of time for bringing the toner concentration represented by a value detected by the toner concentration detection means to a toner concentration represented by the threshold value but is set to a period of time which is shorter than the above-mentioned period of time, i.e., set to a period of time required for bringing the toner concentration represented by a value detected by the toner concentration detection means to a predetermined toner concentration which is smaller than the toner concentration represented by the threshold value.

In the image-forming machine provided according to the fifth aspect of the present invention employing a downstream-side conveyer/stirrer mechanism and/or an upstream-side conveyer/stirrer mechanism disposed in the developing agent container, the developing agent is conveyed sufficiently favorably through the upstream-side passage and the downstream-side passage by the action of a number of paddling pieces of a particular shape disposed on the peripheral surface of the rotary shaft. Besides, the developing agent is sufficiently stirred in the upstream-side passage enabling the toner and carrier particles to be very homogeneously mixed together and enabling the toner to be electrically charged to a sufficient degree and/or the developing agent to be sufficiently uniformly distributed over the whole downstream-side passage.

In the image-forming machine provided according to the sixth aspect of the present invention, a uniformalizing member of a particular shape disposed on the upstream side of the developing agent limiting member as viewed in a direction in which the sleeve member rotates exhibits its uniformalizing action before the developing agent limiting member exerts its action on the developing agent, and the developing agent held on the peripheral surface of the sleeve member is distributed sufficiently uniformly in the direction of width by the action of the uniformalizing member and the action subsequently exhibited by the developing agent limiting member.

In the image-forming machine provided according to the seventh aspect of the present invention, the developing agent held on the peripheral surface of the sleeve member that happens to flow outwardly in the direction of width through both ends of the sleeve member in the regions where no sealing member exists, is guided toward the inside owing to the action of portions that extend in an inclined manner in the downstream direction toward the inside in the direction of width at the upstream end edges of the sealing member. Thus, the developing agent is reliably prevented from flowing out of the developing agent container.

DETAILED DESCRIPTION OF THE PREFERRED EMBODIMENTS

Preferred embodiments of the image-forming machine constituted according to the present invention will now be described in detail with reference to the accompanying drawings.

Outline of the Whole Constitution of the Image-Forming Machine

Figure 1:
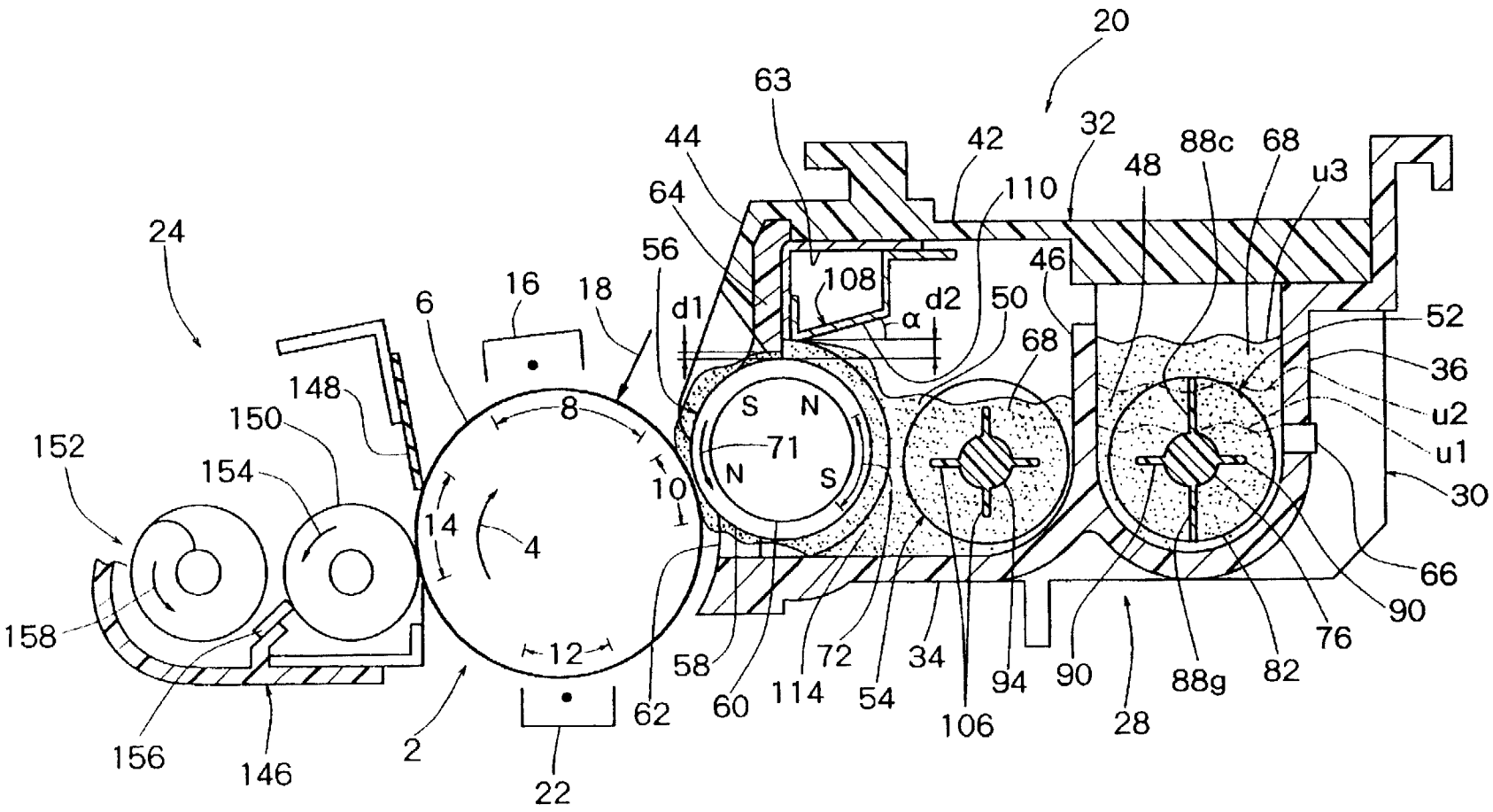
FIG. 1 is a sectional view which illustrates major portions of a preferred embodiment of an image-forming machine constituted according to the present invention.

With reference to FIG. 1, the image-forming machine includes a rotary drum 2 that rotates in a direction indicated by arrow 4. An image carrier member 6 is disposed on the peripheral surface of the rotary drum 2. The image carrier member 6 constituting the image carrier means can be made up of a suitable electrostatic photosensitive material. With the rotation of the rotary drum 2 in the direction indicated by arrow 4, the image carrier member 6 moves through an endless passage defined by the peripheral surface of the rotary drum 2, and passes through an electrostatic latent image-forming zone 8, a developing zone 10, a transfer zone 12 and a cleaning zone 14 in this order. In the electrostatic latent image-forming zone 8, the surface of the image carrier member 6 is uniformly charged with a particular polarity by the action of a corona discharger 16 and, then, the image carrier member 6 is irradiated with light corresponding to image that is to be formed, as schematically indicated by arrow 18, whereby the electric charge is selectively extinguished and an electrostatic latent image is formed on the image carrier member 6. In the developing zone 10, the toner is applied to the electrostatic latent image on the image carrier member 6 by the action of a developing means that is generally designated at 20, and the electrostatic latent image is developed into a toner image. In the transfer zone 12, the toner image on the image carrier member 6 is transferred onto a sheet material (not shown) that is conveyed passing through the transfer zone 12. At this moment, a transfer discharge current is supplied from a corona discharger 22 to the back surface of the sheet material such as a common paper. In the cleaning zone 14, the residual toner is removed from the image carrier member 6 by the action of a cleaning means generally designated at 24. In the image-forming machine is further disposed a toner recycling means 26 (FIG. 4) for recycling the toner that has been removed from the image carrier member 6 by the cleaning means 24, into the developing means 20. The developing means 20, cleaning means 24 and toner recycling means 26 will be described below in detail.

Outline of the Developing Means

Figure 2:
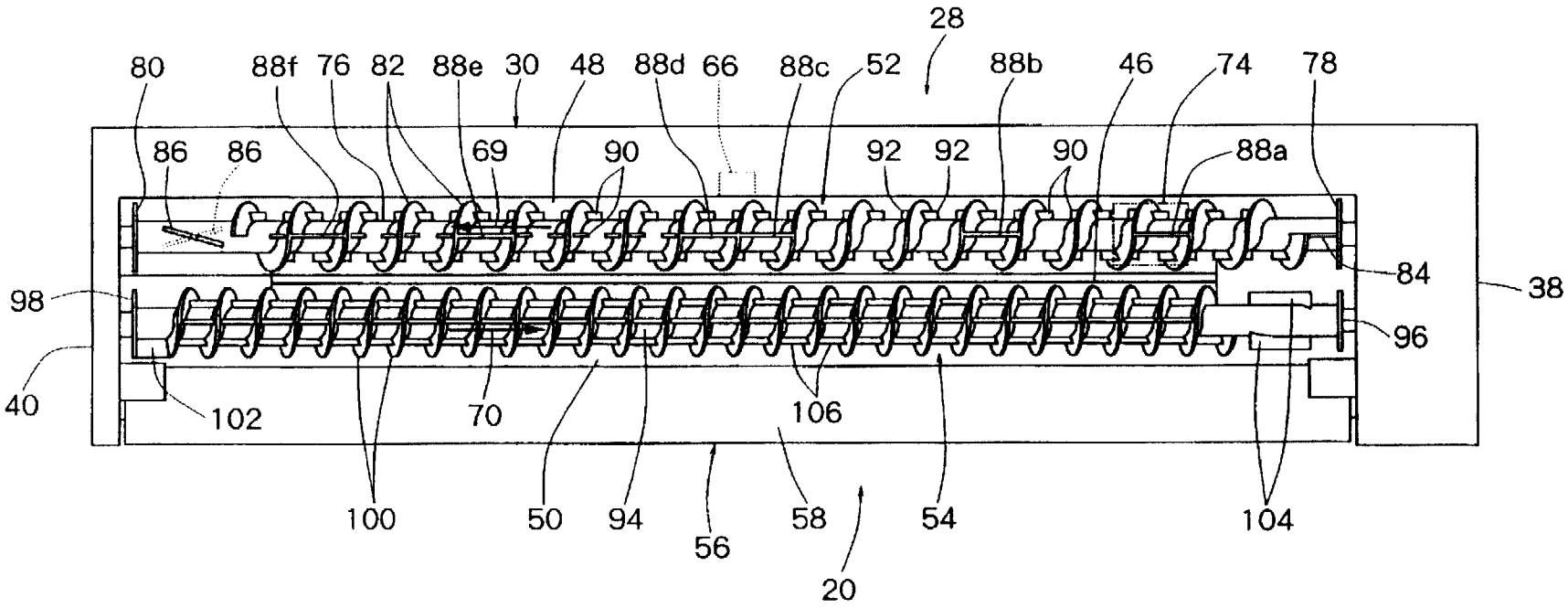
FIG. 2 is a plan view which illustrates, partly in a cut-away manner, a developing agent container, a developing agent application means, an upstream-side conveyer/stirrer mechanism and a downstream-side conveyer/stirrer mechanism in a developing means disposed in the image-forming machine shown in FIG. 1.

With reference to FIG. 2 together with FIG. 1, the developing means 20 includes a developing agent container 28 which is constituted by a lower member 30 and an upper member 32. The lower member 30 has a bottom wall 34, a rear wall 36 and both side walls 38 and 40. The upper member 32 has an upper wall 42 and a front wall 44. The lower member 30 and the upper member 32 are coupled together to form a developing agent container as shown in FIG. 1. In the lower member 30 is integrally formed a separator wall 46 which upwardly protrudes substantially vertically from the bottom wall 34 except both side portions thereof. Space in the developing agent container 28 is divided by the separator wall 46 into an upstream-side passage 48 (passage on the right side of the separator wall 46 in FIG. 1, or passage on the upper side of the separator wall 46 in FIG. 2) and a downstream-side passage 50 (passage on the left side of the separator wall 46 in FIG. 1, or passage on the lower side of the separator wall 46 in FIG. 2). In the upstream-side passage 48 is disposed an upstream-side conveyer/stirrer mechanism 52 and in the downstream-side passage 50 is disposed a downstream-side conveyer/stirrer mechanism 54. The developing agent container 28 includes a developing agent application means 56 which is constituted by a rotary sleeve member 58 that extends in the direction of width (direction perpendicular to the surface of the paper in FIG. 1 or right-and-left direction in FIG. 2) along the downstream-side conveyer/stirrer mechanism 54 and a stationary magnet member 60 disposed within the sleeve member 58. In the front surface of the developing agent container 28 is formed an opening 62 that extends in the direction of width, and the sleeve member 58 of the developing agent application means 28 partly protrudes forward through the opening 62 and is brought close to the peripheral surface of the rotary drum 2 in the developing zone 10. A developing agent limiting member 64 is secured to the upper member 32 of the developing agent container 28 via a coupling piece 63. The developing agent limiting member 64 hangs down substantially vertically toward the sleeve member 58, and a gap d1 which is desirably from about 0.3 to about 0.8 mm is formed between the tip of the developing agent limiting member 64 and the peripheral surface of the sleeve member 58. A toner density detection means 66 is disposed nearly at the center in the direction of width of the rear wall 36 of the developing agent container 28. The toner density detection means 66 can be constituted by a magnetic permeability detector of which the detection surface is exposed to the upstream-side passage 48.

The developing agent container 28 contains a developing agent 68 which comprises a toner and carrier particles. The developing agent 68 is conveyed from one end portion to the other end portion of the upstream-side passage 48 as indicated by arrow 69 (from the right end toward the left end in FIG. 2) while being stirred by the action of the upstream-side conveyer/stirrer mechanism 52, and is conveyed from the other end of the upstream-side passage 48 (left end in FIG. 2) toward the other end of the downstream-side passage 50 (left end in FIG. 2). In the downstream-side passage 50, the downstream-side conveyer/stirrer mechanism 54 conveys with stirring the developing agent 68 from the other end toward the one end (from the left end toward the right end in FIG. 2) as indicated by arrow 70 and further conveys it from one end of the downstream-side passage (right end in FIG. 2) toward one end of the upstream-side passage 48 (right end in FIG. 2). Thus, the developing agent 68 is circulated through the upstream-side passage 48 and the downstream-side passage 50, and the toner and carrier particles are stirred while they are being circulated, so that the toner is electrically charged into a predetermined polarity. Constitutions and actions of the upstream-side conveyer/ stirrer mechanism 52 and of the downstream-side conveyer/stirrer mechanism 54 will be described later in further detail. The sleeve member 58 of the developing agent application means 56 is rotated in a direction indicated by arrow 71 in FIG. 1. In a developing agent drawing-up region 72, the developing agent 68 is held on the peripheral surface of the sleeve member 58 while being magnetically attracted by the stationary magnetic member 60. The thus held developing agent 68 is conveyed to the developing zone 10 and is applied onto the electrostatic latent image on the image carrier member 6, so that the toner is selectively adhered onto the image carrier member 6 to develop a toner image. The developing agent limiting member 64 limits the amount of the developing agent 68 that is held on the peripheral surface of the sleeve member 58 and conveyed to the developing zone 10. As the toner in the developing agent 68 is consumed with the execution of the developing operation and as the toner concentration in the developing agent 68 becomes lower than a predetermined value, the developing agent container 28 is replenished with the toner owing to the action of a toner replenishing means that will be described later. In the upper member of the developing container 28 is formed a toner replenishing opening 74 as indicated by a two-dot chain line in FIG. 2, and the toner is fed into the upstream-side passage 48 through the toner replenishing opening 74. Replenishing the toner will be described later in further detail.

Upstream-Side and Downstream-Side Conveyer/Stirrer Mechanisms in the Developing Means With further reference to FIGS. 1 and 2, the upstream-side conveyer/stirrer mechanism 52 has a rotary shaft 76 that is rotatably installed between the two side walls 38 and 40 of the lower member 30 in the developing agent container 28 and extending in the upstream-side passage 48. Circular flanges 78 and 80 are formed at both ends of the rotary shaft 76. A continuous spiral vane 82 is formed on the rotary shaft 76 between the circular flanges 78 and 80. The circular flanges 78, 80 and the spiral vane 82 may have substantially the same outer diameter. The gap is relatively small between one end of the spiral vane 82 and the circular flange 78 but the gap is relatively large between the other end of the spiral vane 82 and the circular flange 80. An end paddling piece 84 is formed between one end of the spiral vane 82 and the circular flange 78, the end paddling piece 84 extending in the radial direction from the peripheral surface of the rotary shaft 76 and further extending straight and continuously in the axial direction from one end of the spiral vane 82 up to the circular flange 78. The front end in the radial direction of the end paddling piece 84 is located substantially in alignment with the outer peripheral edge of the spiral vane 82 (or, in other words, the radius of a circular locus described by the front end in the radial direction of the end paddling piece 84 with the rotation of the rotary shaft 76 is substantially the same as the radius of the outer peripheral edge of the spiral vane 82). A pair of transfer paddling pieces 86 are formed on the rotary shaft 76 between the other end of the spiral vane 82 and the circular flange 80 each of the transfer paddling pieces being position at angle of 180 degrees apart from each other. The pair of transfer paddling pieces 86 extend toward the circular flange 80 being tilted to some extent in the clockwise direction as viewed from the right side in FIG. 2. It is desired that the front ends in the radial direction of the pair of transfer paddling pieces 86 are positioned substantially in alignment with the outer peripheral edge of the spiral vane 82 or slightly on the inside thereof. As clearly shown in FIG. 2, on the peripheral surface of the rotary shaft 76 are formed nearly rectangularly-shaped large paddling pieces 88*a*, 88*b*, 88*c*, 88*d*, 88*e* and 88*f* that extend in the radial direction from the peripheral surface of the rotary shaft 76 and extend in the axial direction across the spiral vane 82. These six large paddling pieces 88*a*, 88*b*, 88*c*, 88*d*, 88*e* and 88*f* are disposed at substantially the same angular positions, extending straight across the spiral vane 82, the front edges in the radial direction thereof being located substantially in alignment with the outer peripheral edge of the spiral vane 82. As illustrated in FIG. 1, furthermore, at the central portion of the rotary shaft 76 are formed a pair of large paddling pieces 88*g* apart at an angle of 180 degrees and being opposed to the large paddling pieces 88*c* and 88*d*. The large paddling pieces 88*g* are nearly of a rectangular shape extending straight continuously between across spiral vane 82, the front edges in the radial direction thereof being located substantially in alignment with the outer peripheral edge of the spiral vane 82. On the peripheral surface of the rotary shaft 76 are further formed a number of nearly rectangularly-shaped small paddling pieces 90 extending in the radial direction from the peripheral surface of the rotary shaft 76 and further extending in the axial direction across the spiral vane 82. As will be understood with reference to FIG. 2, the small paddling pieces 90 are formed in an angular distance of 180 degrees on a half portion of the rotary shaft 76 (right half portion in FIG. 2), and are formed in an angular distance of 90 degrees in the other half portion of the rotary shaft 76 (left half portion in FIG. 2). Accordingly, the number of the small paddling pieces 90 formed on one half portion of the rotary shaft 76 is one-half the number of the small paddling pieces 90 formed on the other half portion of the rotary shaft 76. The small paddling pieces 90 do not continuously extend across the spiral vane 82; i.e., no paddling piece exists in the central regions across the spiral vane 82 in the axial direction. It is further desired that the length of protrusion of the small paddling pieces 90 in the radial direction is shorter than the length of protrusion of the large paddling pieces 88*a*, 88*b*, 88*c*, 88*d*, 88*e* and 88*f* in the radial direction, and that the length from the peripheral surface of the rotary shaft 76 to the front ends of the small pieces 90 in the radial direction is nearly one-half the length from the peripheral surface of the rotary shaft 76 to the outer peripheral edge of the spiral vane 82 in the radial direction.

In the upstream-side conveyer/stirrer mechanism 52 described above, the rotary shaft 76 is rotated in the clockwise direction as viewed from the right side in FIG. 2, and the spiral vane 82 conveys, while stirring, the developing agent 68 in a direction indicated by arrow 69 (in a direction from the right to the left in FIG. 2). The large paddling pieces 88*a*, 88*b*, 88*c*, 88*d*, 88*e*, 88*f* and 88*g* as well as many small paddling pieces 90 force the developing agent 68 in the direction in which the rotary shaft 76 rotates to promote the stirring of the developing agent 68 by the spiral vane 82. In general, the action for stirring the developing agent 68 increases with an increase in the length of protrusion of the paddling pieces in the radial direction resulting, however, in a decrease in the conveying action in the direction indicated by arrow 69. In view of the above-mentioned fact in the illustrated upstream-side conveyer/stirrer mechanism 52, the length of protrusion of many small paddling pieces 90 in the radial direction is set to be nearly one-half the length of protrusion of the large paddling pieces 88*a*, 88*b*, 88*c*, 88*d*, 88*e*, 88*f* and 88*g*, so that the conveyance and stirring of the developing agent 68 are suitably balanced. The number of the small paddling pieces 90 on a half portion of the rotary shaft 76, i.e., on the right half portion in FIG. 2 is one-half the number of the small paddling pieces 90 in the other half portion of the rotary shaft 76, i.e., on the left half portion in FIG. 2. Accordingly, the upper surface level u1 of the developing agent 68 in the half portion of the rotary shaft 76 and, particularly, in a region where the toner replenishing opening 74 is disposed becomes slightly lower than an average upper surface level u2 (upper surface level of the developing agent in the other half portion of the rotary shaft 76). Accordingly, the replenished toner falling through the toner replenishing opening 74 is very favorably mixed into the developing agent 68 which is present in the upstream-side passage 48. In a region where the toner concentration detection means 66 is disposed, on the other hand, the upper surface level u3 of the developing agent 68 becomes slightly higher than the average upper surface level u2 due to the presence of large paddling pieces 88*c*, 88*d* and 88*g*. This makes it possible to reliably prevent the toner concentration detection means 66 from erroneously detecting the toner concentration. Attention should further be given to the following fact in relation to the upstream-side conveyer/stirrer mechanism 52. That is, a number of small paddling pieces 90 are not continuously extending across the spiral vane 82 in the axial direction; i.e., no paddling piece exists in the intermediate regions across the spiral vane 82 in the axial direction, but there are formed side edges 92 of the small paddling pieces 90. While the rotary shaft 76 is rotated, therefore, the side edges 92 of small paddling pieces 90 impart the so-called shearing action to the developing agent 68 in the intermediate regions across the spiral vane 82 in the axial direction, so that the stirring action for the developing agent 68 is greatly increased by the shearing action. In the upstream-side passage 48, as described above, the developing agent 68 is conveyed in a direction indicated by arrow 69 at a desired conveying factor and is very favorably stirred while being conveyed. The developing agent 68 conveyed up to the other end portion of the upstream-side passage 48 (conveyed up to the left end portion in FIG. 2) is transferred into the downstream-side passage 50 by the action of the pair of transfer paddling pieces 86.

Described below is the downstream-side conveyer/stirrer mechanism 54 which has a rotary shaft 94 that is rotatably mounted between both side walls 38 and 40 of the lower member 30 of the developing container 28 and extending in the downstream-side passage 50. Circular flanges 96 and 98 are formed at both ends of the rotary shaft 94. A continuous spiral vane 100 is formed on the rotary shaft 94 between the circular flanges 96 and 98. The circular flanges 96, 98 and the spiral vane 100 may have substantially the same outer diameter. The gap is relatively small between one end of the spiral vane 100 and the circular flange 98 but the gap is relatively large between the other end of the spiral vane 100 and the circular flange 96. An end paddling piece 102 is formed between one end of the spiral vane 100 and the circular flange 98, the end paddling piece 102 extending in the radial direction from the peripheral surface of the rotary shaft 94 and further extending straight and continuously in the axial direction from one end of the spiral vane 100 up to the circular flange 98. The front end in the radial direction of the end paddling piece 102 is located substantially in alignment with the outer peripheral edge of the spiral vane 100 (or, in other words, the radius of a circular locus described by the front end in the radial direction of the end paddling piece 102 with the rotation of the rotary shaft 94 is substantially the same as the radius of the outer peripheral edge of the spiral vane 100). A pair of transfer paddling pieces 104 are formed on the rotary shaft 94 in an angular distance of 180 degrees between the other end of the spiral vane 100 and the circular flange 96. The pair of transfer paddling pieces 104 extend toward the circular flange 96 being tilted to some extent in the counterclockwise direction as viewed from the right side in FIG. 2. It is desired that the front ends in the radial direction of the pair of transfer paddling pieces 104 are positioned substantially in alignment with the outer peripheral edge of the spiral vane 100 or slightly on the inside thereof. As clearly shown in FIG. 2, on the peripheral surface of the rotary shaft 94 are formed a number of nearly rectangularly-shaped middle paddling pieces 106 that extend in the radial direction from the peripheral surface of the rotary shaft 94 and extend in the axial direction across the spiral vane 100. These middle paddling pieces 106 are arranged substantially uniformly over the whole region of the spiral vane 100. The middle paddling pieces 106 are disposed in an angular distance of 90 degrees over the whole region where the spiral vane 100 is formed in the axial direction, and extend continuously and substantially straight across the spiral vane 100. The length of protrusion of the middle paddling pieces 106 in the radial direction has been set to be substantially the same as the length of protrusion in the radial direction of the small paddling pieces in the above-mentioned upstream-side conveyer/stirrer mechanism 52, and the length from the peripheral surface of the rotary shaft 94 to the front ends of the middle paddling pieces 106 in the radial direction is nearly one-half the length from the peripheral surface of the rotary shaft 94 to the outer peripheral edge of the spiral vane 100 in the radial direction.

In the downstream-side conveyer/stirrer mechanism 54 described above, the rotary shaft 94 is rotated in the counterclockwise direction as viewed from the right side in FIG. 2 (i.e., rotated in a direction opposite to the direction in which the rotary shaft 76 of the above-mentioned upstream-side conveyer/stirrer mechanism 52 is rotated), and the stirrer vane 100 conveys, while stirring, the developing agent 68 in a direction indicated by arrow 70 (i.e., in a direction from the left to the right in FIG. 2). The intermediate paddling pieces 106 force the developing agent 68 toward the direction in which the rotary shaft 94 rotates to promote the stirring of the developing agent 68 by the spiral vane 100. Attention should further be given to the following fact in regard to the intermediate paddling pieces 106 in the downstream-side conveyer/stirrer mechanism 54. As described above, the sleeve member 58 of the developing agent application means 28 draws up the developing agent 68 that exists in the downstream-side passage 50 in the developing agent drawing-up zone 72 and conveys it to the developing zone 10. To accomplish the sufficiently uniform developing in the direction of width, i.e., over the whole width of the sleeve member 58 in the axial direction, it is important that the developing agent 68 is drawn up very uniformly onto the whole peripheral surface of the sleeve member 58 in the axial direction thereof. For this purpose, it is important that the developing agent 68 exists very uniformly in the downstream-side passage 50 over nearly the whole length thereof. When the spiral vane 100 only is formed on the peripheral surface of the rotary shaft 94, however, spots tend to be formed on the developing agent 68 that is drawn up onto the peripheral surface of the sleeve member 58, the spots spirally extending being corresponded to the spiral vane 100. The present inventors have confirmed through experiment that the intermediate paddling pieces 106 that are evenly arranged over the whole spiral vane 100 help suppress the occurrence of spots of the developing agent 68 that is drawn up onto the peripheral surface of the sleeve member 58 and work to uniformalize the developing agent 68 that is drawn up onto the peripheral surface of the sleeve member 58. Moreover, attention should be given to the following fact in regard to the intermediate paddling pieces 106. That is, it is important that balance is maintained between the action for conveying the developing agent in the direction indicated by arrow 69 by the upstream-side conveyer/stirrer mechanism 52 and the action for conveying the developing agent in the direction indicated by arrow 70 by the downstream-side conveyer/stirrer mechanism 54. Otherwise, the developing agent 68 is maldistributed in either the upstream-side passage 48 or the downstream-side passage 50. On account of the above-mentioned variety of reasons, the upstream-side conveyer/stirrer mechanism 52 has large paddling pieces 88*a*, 88*b*, 88*c*, 88*d*, 88*e*, 88*f* and 88*g* that exhibit large conveyance suppressing action and small paddling pieces 90 that exhibit small conveyance suppressing action, that are suitably arranged. On the other hand, the downstream-side conveyer/stirrer mechanism 54 has intermediate paddling pieces 106 that exhibit conveyance suppressing action which is between that of the large paddling pieces 88*a*, 88*b*, 88*c*, 88*d*, 88*e*, 88*f* and 88*g* and that of the small paddling pieces 90, the intermediate paddling pieces 106 being evenly arranged over the whole spiral vane 100. Thus, balance is maintained between the action for conveying the developing agent in the direction indicated by arrow 69 by the upstream-side conveyer/stirrer mechanism 52 and the action for conveying the developing agent in the direction indicated by arrow 70 by the downstream-side conveyer/stirrer mechanism 54.

Uniformalizing Member in the Developing Means

With further reference to FIG. 1, to the coupling piece 63 that couples the developing agent limiting member 64 to the upper member 32 of the developing agent container 28 is further secured a uniformalizing member 108 that is located on the upstream side of the developing agent limiting means 64 as viewed in a direction in which the sleeve member 58 rotates in the developing agent application means 56. The coupling piece 63 has a hanging portion that hangs down substantially vertically, the developing agent limiting member 64 is secured to one surface of the hanging portion (left surface in FIG. 1) and the uniformalizing member 108 is secured to the other surface (right surface in FIG. 1). Like the developing agent limiting means 64, the uniformalizing member 108 extends along the peripheral surface of the sleeve member 58 in the direction of width (in a direction perpendicular to the surface of the paper in FIG. 1). The uniformalizing member 108 has a working surface 110 that gradually approaches the peripheral surface of the sleeve member 58 toward the downstream side as viewed in the direction in which the sleeve member 58 rotates, i.e., toward the developing agent limiting member 64. It is important that a gap d2 between the downstream end edge of the working surface and the peripheral surface of the sleeve member 58 is larger than the gap d1 between the developing agent limiting member 64 and the peripheral surface of the sleeve member 58 but is smaller than the thickness of the layer of the developing agent 68 that is drawn up and is held on the peripheral surface of the sleeve member 58 in the developing agent drawing-up zone 72. Preferably, the gap d2 should be from about 1.0 to about 3.0 mm. The lower edge of the hanging portion of the coupling piece 63 located between the developing agent limiting member 64 and the uniformalizing member 108 is brought into substantial alignment with the downstream end edge of the working surface 110 of the uniformalizing member 108. The working surface of the uniformalizing member 108 extends being inclined at an angle $\alpha$ which may preferably be from 20 to 30 degrees with respect to a tangential line (which extends substantially horizontally in the illustrated embodiment) at a portion where the downstream end edge of the working surface 110 of the uniformalizing member 108 is opposed to the peripheral surface of the sleeve member 58.

In the downstream-side conveyer/stirrer mechanism 54 as described above, the spiral vane 100 is formed on the peripheral surface of the rotary shaft 94, and the middle paddling pieces 106 are arranged over the whole region of the spiral vane 100. Therefore, the layer of the developing agent 68 that is drawn up and is held on the peripheral surface of the sleeve member 58 in the developing agent drawing-up zone 72 has a relatively uniform thickness in the direction of width. The thickness, however, is not uniform to a satisfactory degree, and nonuniformity still exists to some extent due to the presence of the spiral vane 100. According to experiments conducted by the present inventors, it has been found that when the uniformalizing member 108 is not disposed, nonuniformity of the layer of the developing agent 68 held on the peripheral surface of the sleeve member 58 is not remedied to a sufficient degree by the developing agent limiting member 64; i.e., nonuniformity still remains to some extent in the layer of the developing agent 68 that is conveyed into the developing zone 10. When the uniformalizing member 108 is disposed, on the other hand, the uniformalizing member first acts upon the developing agent 68 that is held on the peripheral surface of the sleeve member 58 to uniformalize it in the direction of width and, then, the developing agent limiting member 64 acts to limit the thickness of the layer of the developing agent 68 as desired. Thus, the developing agent 68 held on the peripheral surface of the sleeve member 58 is uniformalized to a sufficient degree in the direction of width to acquire a predetermined thickness.

Sealing Member in the Developing Means

Figure 3:
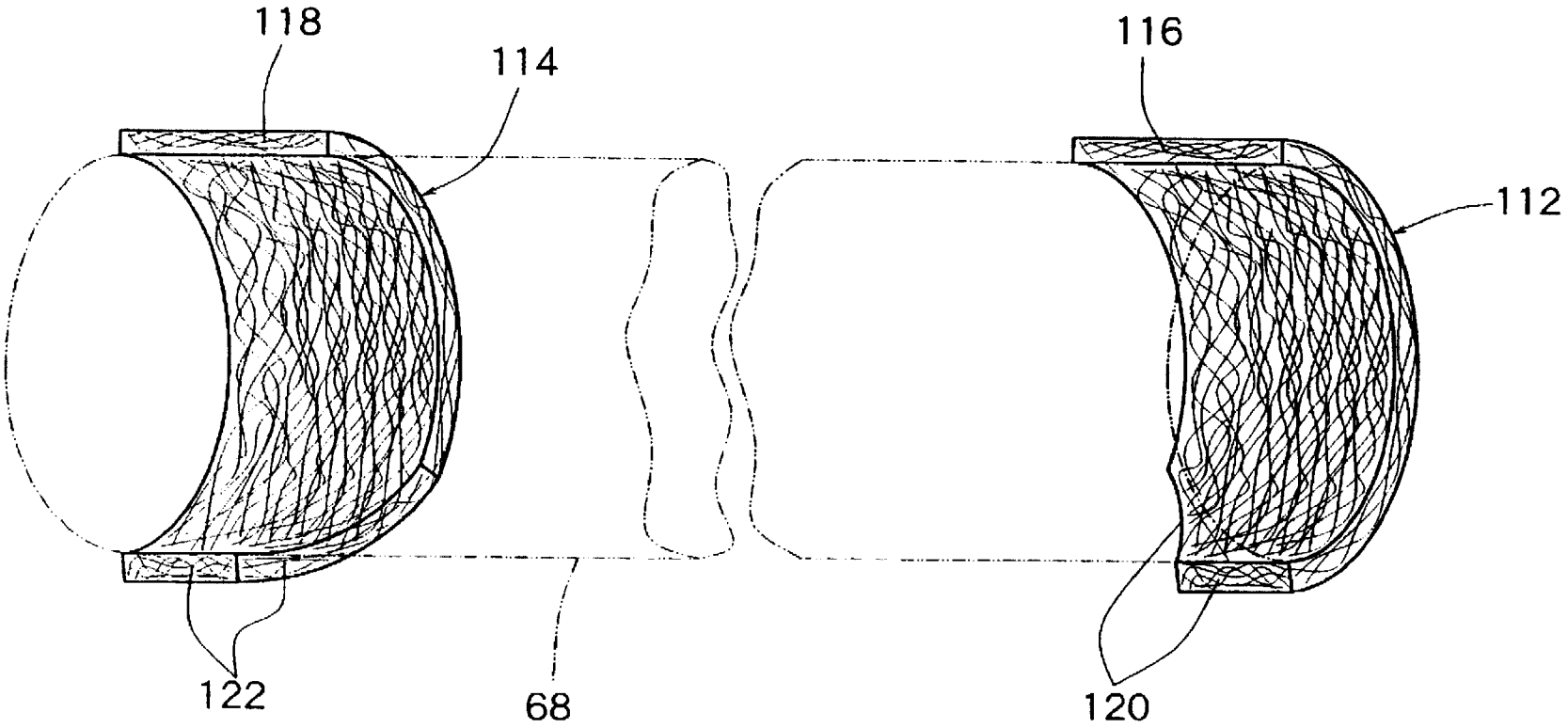
FIG. 3 is a perspective view illustrating portions of sealing members in the developing device disposed in the image-forming machine shown in FIG. 1.

Referring to FIG. 3 together with FIG. 1, stationary sealing members 112 and 114 that are brought into intimate contact with both ends of the sleeve member 58 of the developing agent application means are disposed on both side walls 38 and 40 of the lower member 30 of the developing agent container 28. As will be easily understood from FIG. 1, each of the sealing members 112 and 114 which are desirably made of a felt, extends arcuately along the peripheral surface of the sleeve member 58 over a range of as wide as about 200 degrees, the downstream end thereof is located on the upstream side of the sleeve member 58 as viewed in the direction in which the sleeve member 58 rotates and close to the developing agent limiting member 64, and the upstream end thereof is located slightly on the upstream side of the lowermost end on the peripheral surface of the sleeve member 58. As clearly shown in FIG. 3, the downstream end edges 116 and 118 of the sealing members 112 and 114 extend substantially horizontally in the direction of width thereof. However, the upstream end edges 120 and 122 of the sealing members 112 and 114 are extending substantially horizontally in the direction of width in the outer half portion but are extending being inclined toward the downstream direction and inwardly in the inner half portion in the direction of width.

The sealing members 112 and 114 prevent the developing agent 68 from moving toward both end portions along the peripheral surface of the sleeve member 58 in the developing agent application means 56. The sealing members 112 and 114, however, are in an arcuate shape, and there exists no sealing member over a range from the downstream end edges 116 and 118 of the sealing members 112 and 114 up to the upstream end edges 120 and 122 (in most of this range, the peripheral surface of the sleeve member 58 is exposed out of the developing agent container 28 through the opening 62). Therefore, the developing agent 68 tends to flow toward both sides in the direction of width exceeding the limiting ends that are defined by the inner edges of the sealing members 112 and 114 when the developing agent 68 held on the peripheral surface of the sleeve member 58 moves in a direction indicated by arrow 71 passing through the above-mentioned range. In the conventional sealing members, not only the downstream end edges but also the upstream end edges are extending substantially horizontally in the direction of width, permitting the developing agent 68 that has flown to both sides in the direction of width exceeding the limiting ends to stay on the upstream end edges of the sealing members and, hence, permitting the developing agent 68 to scatter around as it stays in excess amounts. Using the above-mentioned sealing members 112 and 114, however, since the inner half portions of the upstream end edges 120 and 122 in the direction of width are inclined inwardly in the direction of width and in the downstream direction, the developing agent 68 that has flown toward both sides in the direction of width exceeding the limiting ends in the above-mentioned range is returned back toward the inside in the direction of width being guided by the tilted inner half portions of the upstream end edges 120 and 122 of the sealing members 112 and 114 as it moves in the direction of arrow 71 with the rotation of the sleeve member 58. Accordingly, the developing agent 68 is effectively prevented from staying in an excess amount on the upstream end edges 120 and 122 of the sealing members 112 and 114.

Toner Replenishing Means in the Developing Means

Figure 4:
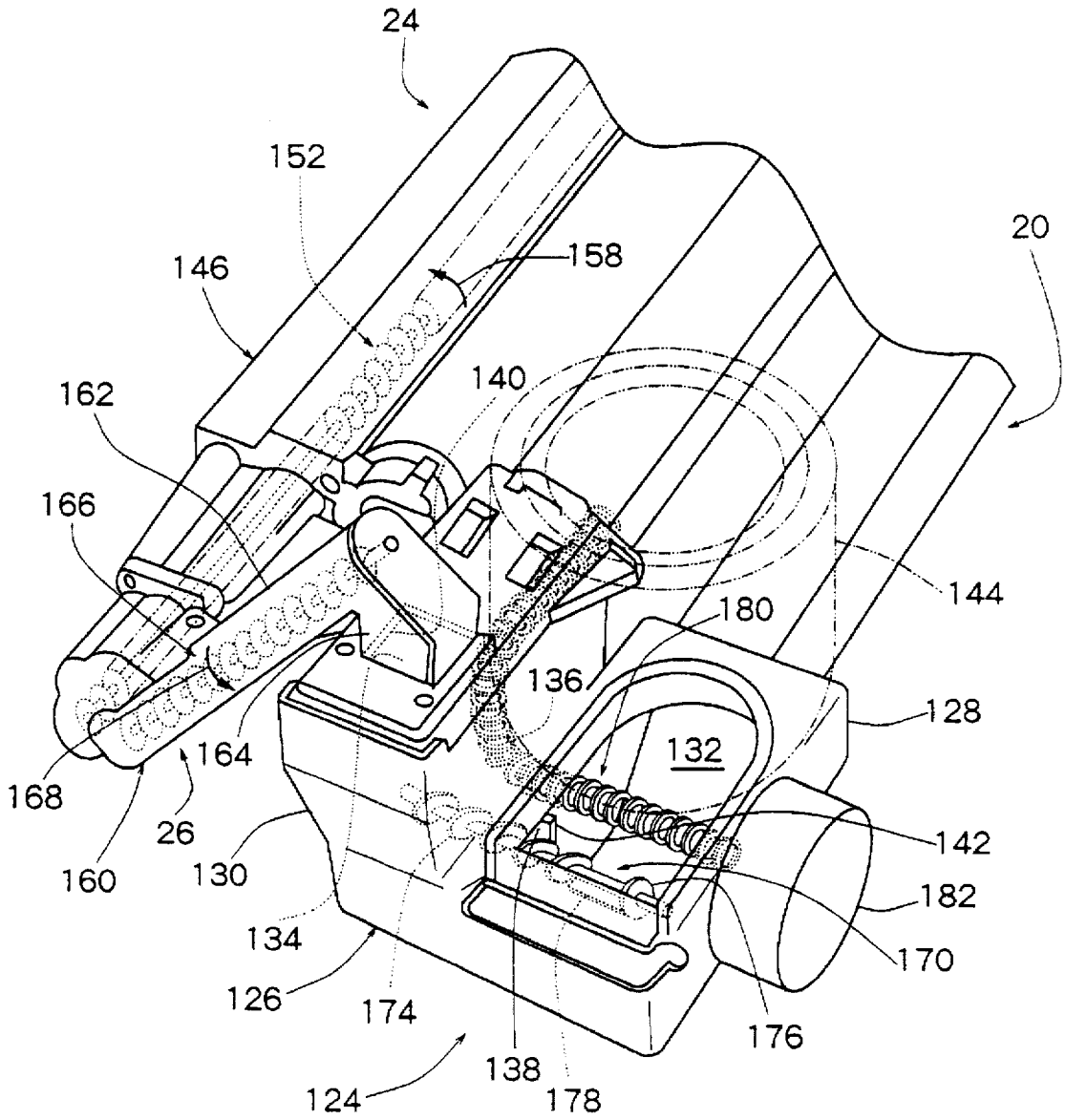
FIG. 4 is a partial perspective view a toner replenishing means in the developing device, a portion of the cleaning means and a toner recycling means in the image-forming machine shown in FIG. 1.
Figure 5:
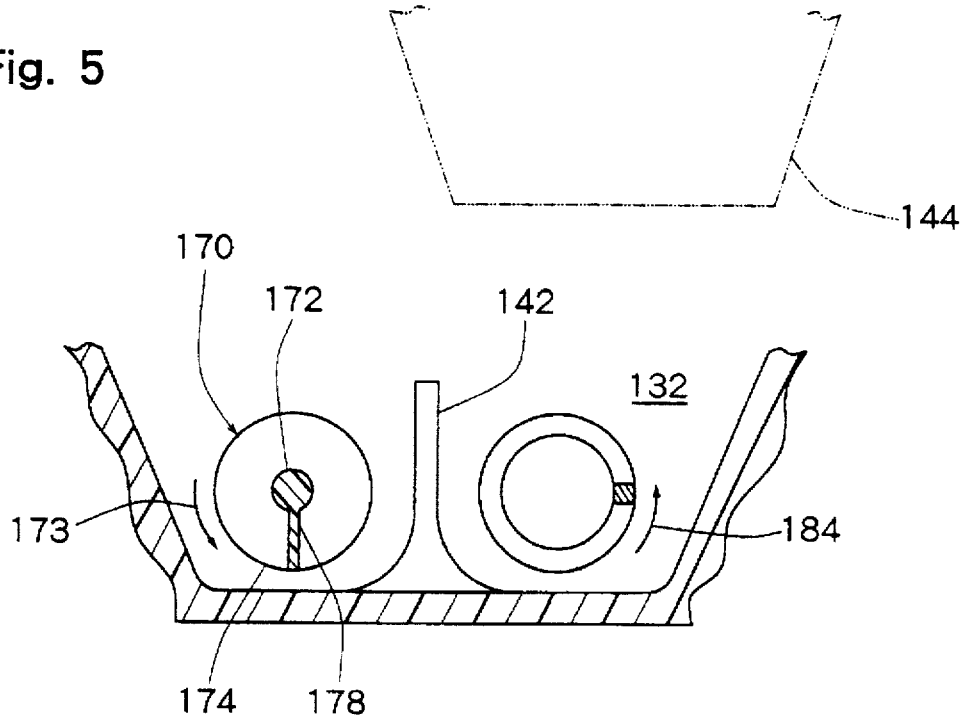
FIG. 5 is a sectional view illustrating a portion of the toner replenishing means that is shown in FIG. 4.
Figure 6:
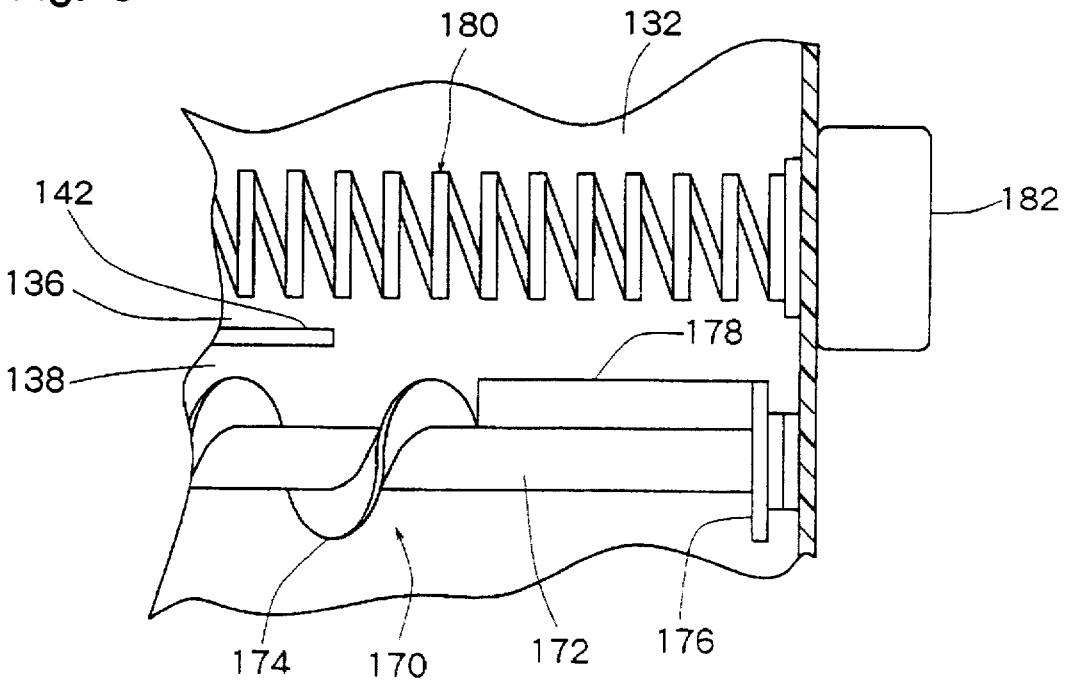
FIG. 6 is a sectional view illustrating a portion of the toner replenishing means that is shown in FIG. 4.

With reference to FIG. 4, the developing means 20 includes a toner replenishing means that is generally designated at 124. The toner replenishing means 124 is equipped with a housing structure 126 which is formed by assembling a plurality of plastic members. The housing structure 126 has a relatively low half portion 128 and another relatively high half portion 130. In the housing structure 126 are defined a mixing chamber 132, a recycled toner receiving chamber 134, a toner introduction passage 136 and a recycled toner sending passage 138. With reference to FIGS. 5 and 6 together with FIG. 4, the mixing chamber 132 is disposed at a corner in the housing structure 126 (at a right portion in FIG. 5, or at a right upper portion in FIG. 6) or, more specifically, is disposed on one side in the half portion 128 of the housing structure 126, and has its one side surface (left surface in FIG. 5, or lower surface in FIG. 6), upper surface and front surface (left surface in FIG. 6) open. The recycled toner receiving chamber 134 is disposed at a corner that is opposed to the corner at which the mixing chamber 132 is located in the housing structure 126 or, more specifically, is disposed on the other side in the half portion 130. The recycled toner receiving chamber 134 downwardly extends substantially vertically from a receiving opening 140 formed in the upper surface of the other relatively high half portion 130 of the housing structure 124, and has its one end surface (right surface in FIG. 4) at the lower portion open. The toner introduction passage 136 extends rightwards in FIG. 6 from the open front surface of the mixing chamber 132, then upwards and, then, toward the upper surface of the developing agent container 28. The upstream end of the toner introduction passage 136 is divided by a partitioning wall 142 into the recycled toner sending passage 138 and the recycled toner receiving chamber 134, and the midstream portion and the downstream portion thereof are defined by hollow portion having a circular shape in cross section, that extends in a curved manner. In the lower surface in the downstream portion of the toner introduction passage 136 is formed a toner discharge opening (not shown) that is brought into match with the toner replenishing opening 74 (FIG. 2) formed in the upper member 32 of the developing agent container 28. The recycled toner sending passage 138 rightwardly extends in FIG. 6 from the open one surface of the recycled toner receiving chamber 134 passing through the other side (left side in FIG. 5 or lower side in FIG. 6) of the half portion 128 of the housing structure 126. In the downstream portion (right portion in FIG. 6) of the recycled toner sending passage 138 as clearly shown in FIGS. 4 and 6, the partitioning wall 142 is not formed, and one surface (right surface in FIG. 5 or upper surface in FIG. 6) in the downstream portion of the recycled toner feeding passage 138 is directly communicated with the open side surface of the mixing chamber 132.

As indicated by a two-dot chain line in FIGS. 4 and 6, a toner cartridge 144 is detachably mounted over the mixing chamber 132 that is defined in the other half portion 130 of the housing structure 126. The toner cartridge 144 constituting a new toner container means may be of a widely known form. A toner discharge port is formed at a lower end of the toner cartridge 144 and is communicated with the open upper surface of the mixing chamber 132. Therefore, the new toner contained in the toner cartridge 144 falls down and is fed into the mixing chamber 132 passing through the toner discharge port formed in the toner cartridge 144 and through the open upper surface of the mixing chamber 132.

With reference to FIG. 1 together with FIG. 4, the cleaning means 24 which by itself may be of a known form includes a cleaning container 146, a cleaning blade 148, a cleaning roller 150 and a toner conveyer means 152. An auxiliary blade 156 is provided for the cleaning roller 150 that is rotated in a direction indicated by arrow 154. An end of the cleaning blade 148 is pressed onto the surface of the image carrier member 6, and the toner remaining on the image carrier member 6 that is rotated in a direction indicated by arrow 4 is removed by the action of the cleaning blade 148 and falls on the cleaning roller 150. The cleaning roller 150 acts upon the surface of the image carrier member 6 to remove the remaining toner and while holding on the peripheral surface thereof the toner removed therefrom and the toner that has fallen thereon by the action of the cleaning blade 148, conveys these toners in the direction indicated by arrow 154. The toner that is conveyed in the direction of arrow 154 by being held on the peripheral surface of the cleaning roller 150 is then removed from the peripheral surface of the cleaning roller 150 by the action of the auxiliary blade 156, and is collected at a side portion (left side portion in FIG. 1) in the cleaning container 146. The toner conveyer means 152 is constituted by a rotary shaft that extends through the side portion of the cleaning container 146 in the direction of width (direction perpendicular to the surface of the paper in FIG. 1) and by a spiral vane disposed on the peripheral surface of the rotary shaft. The toner conveyer means 152 is rotated in a direction indicated by arrow 158 and conveys the toner collected in the side portion of the cleaning container 146 to the forward direction in FIG. 4. As shown in FIG. 4, the toner recycling means 26 is disposed in relation to the front portion of the cleaning container 146. The toner recycling means 26 includes a hollow member 160 in which a toner recycling passage is formed. The hollow member 160 is constituted by an inclined rising portion 162 that extends upwards being inclined from the front portion of the cleaning container 146 and a hanging portion 164 that extends downwards from the inclined rising portion 162. The lower end of the inclined rising portion 162 is communicated with the cleaning container 146, and the lower end of the hanging portion 164 is communicated with the receiving opening 140 of the recycled toner receiving chamber 134. A recycled toner conveyer means 166 is disposed in the inclined rising portion 162 of the hollow member 160. The recycled toner conveyer means 166 is constituted by a rotary shaft that extends in the inclined rising portion 162 and a spiral vane disposed on the peripheral surface of the rotary shaft. The recycled toner conveyer means 166 is rotated in a direction indicated by arrow 168.

The toner that is removed from the image carrier member 6 by the cleaning blade 148 and the cleaning roller 150 and is collected in the side portion (left portion in FIG. 1) of the cleaning container 146 in the cleaning zone 14, is conveyed to the front portion of the cleaning container 146 by the action of the toner conveyer means 152, and is fed to the upstream end of the hollow member 160 in the toner recycling means 26, i.e., fed to the lower end of the inclined rising portion 162. Then, by the action of the recycled toner conveyer means 166, the toner is conveyed through the inclined rising portion 162 of the hollow member 160 from the lower end thereof to the upper end thereof, and is then allowed to fall down from the upper end of the inclined rising portion 162 through the hanging portion 164 of the hollow member 160, and is contained in the recycled toner receiving chamber 134 through a receiving opening 140.

With reference to FIGS. 4, 5 and 6, in the above-mentioned recycled toner receiving chamber 134 and in the recycled toner feeding passage 138 is disposed a recycled toner sending means 170 which sends the recycled toner contained in the recycled toner receiving chamber 134 to the mixing chamber 132 via a recycled toner sending passage 138. The recycled toner sending means 170 has a rotary shaft 172 that extends through the bottom of the recycled toner receiving chamber 134 and the recycled toner sending passage 138. A spiral vane 174 is disposed on the peripheral surface of the rotary shaft 172 that is rotated in a direction indicated by arrow 173. The spiral vane 172 does not extend in the downstream portion of the rotary shaft (in a right end portion in FIG. 6, or in a portion extending along the open side surface of the mixing chamber 132). A terminal disk 176 is formed at the downstream end of the rotary shaft 172 (at a right end in FIG. 6), and a paddling piece 178 is formed between the terminal disk 176 and the downstream end of the spiral vane 174. As will be easily understood with reference to FIGS. 5 and 6, the paddling piece 178 is of a rectangular shape, and extends in the radial direction from the peripheral surface of the rotary shaft 172 and in the axial direction on the peripheral surface of the rotary shaft 172.

With further reference to FIGS. 4 to 6, a toner introduction means 180 is disposed in the mixing chamber 132 and in the toner introduction passage 136. The toner introduction means 180 is constituted by a spiral spring that extends through the bottom of the mixing chamber 132 and the toner introduction passage 136. It is desired that the spiral spring constituting the toner introduction means 180 is formed by spirally shaping a steel wire having a rectangular shape in cross section but not a circular shape in cross section. As shown in FIGS. 4 and 6, an electric motor 182 for replenishing the toner is mounted on the outer surface of the rear wall (right wall in FIG. 6) of the mixing chamber 132, the output shaft of the electric motor 182 for replenishing the toner protrudes into the mixing chamber 132 penetrating through the rear wall, and an end of the toner introduction means 130 is coupled to the output shaft. When the electric motor 182 for replenishing the toner is energized, the toner introduction means 180 is rotated in a direction indicated by arrow 184, and the developing agent container 28 (FIGS. 1 and 2) is replenished with the toner from the mixing chamber 132 through the toner introduction passage 136. Replenishing the developing agent container 28 with the toner will be described later.

Figure 7:
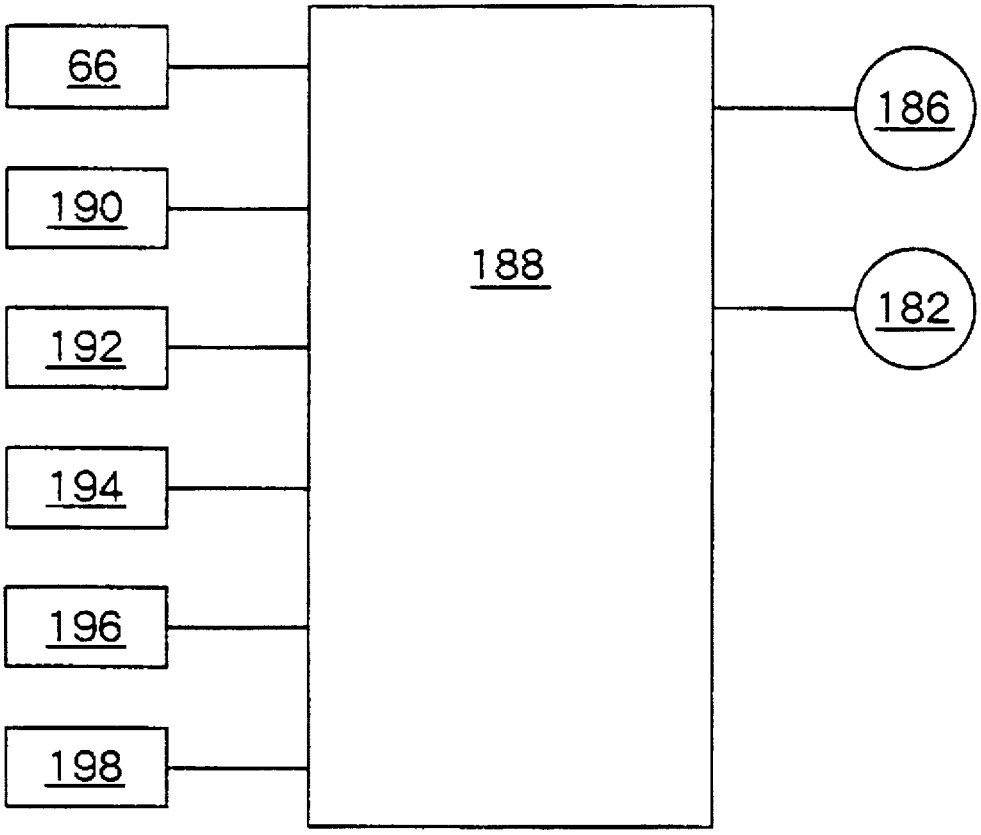
FIG. 7 is a block diagram illustrating control-related elements arranged in the image-forming machine shown in FIG. 1.

The toner conveyer means 152 in the cleaning means 24, the recycled toner conveyer means 166 in the toner recycling means 26 and the toner sending means 170 disposed in the recycled toner sending passage 138 are coupled, via suitable transmission means (not shown), to a main electric motor 186 (FIG. 7) that rotates the rotary drum 2 (the upstream-side conveyer/stirrer mechanism 52 and the downstream-side conveyer/stirrer mechanism 54 disposed in the developing agent container 28 in the developing means 20 can be coupled, via a suitable transmission, to the main electric motor 186, too). Therefore, when the main electric motor 186 is energized and the rotary drum 2 is rotated in a direction indicated by arrow 4, the toner conveyer means 152 in the cleaning means 24, the recycled toner conveyer means 166 in the toner recycling means 26 and the toner sending means 170 disposed in the recycled toner sending passage 138 are operated, too. Thus, the toner removed, in the cleaning zone 14, from the surface of the image carrier member 6 disposed on the peripheral surface of the rotary drum 2, is introduced into the recycled toner receiving chamber 134 from the cleaning means 24 through the toner recycling means, is sent into the mixing chamber 132 from the recycled toner receiving chamber 134 through the toner sending passage 138, and is mixed in the mixing chamber 132 with the new toner that is fed into the mixing chamber 132 from the toner cartridge 144.

The capacity of the recycled toner receiving chamber 134 in the toner replenishing means 124 is set to be about 20% of the capacity of the toner cartridge that constitutes the new toner container means. This will be described below in further detail. When the capacity of the recycled toner receiving chamber 134 is too small, there arouses a problem as described below. That is, the recycled toner will often be fed in large amounts at one time into the recycled toner receiving chamber 134 when a copying step is repeated many times to form image of a document on small sheet materials using an ordinary electrostatic copying machine with the document cover being located at the open position or when the toner is transferred in large amounts at one time in the cleaning means 24 and/or the toner recycling means 26 due to the application of a considerably large physical impact on the cleaning means 24 and/or the toner recycling means 26 as a result of treating the jamming of the sheet materials. In such a case, when the capacity of the recycled toner receiving chamber 134 is too small, the recycled toner may flow over the recycled toner receiving chamber 134 and scatter around. When the recycled toner receiving chamber 134 has a large capacity, on the other hand, the toner replenishing means 124 becomes inevitably bulky. As will be described later, furthermore, operation of the electric motor 182 for replenishing the toner in the toner replenishing means 124 is controlled, i.e., replenishing the developing agent container 28 with the toner from the mixing chamber 132 is controlled depending upon the toner concentration in the developing agent 68 in the developing agent container 28 and, hence, the amount of toner is maintained nearly constant in the developing agent container 28. On the other hand, as is widely known among people skilled in the art, the transfer efficiency is about 80% in an ordinary image-forming machine, 80% of the toner adhered onto the image carrier member 6 is transferred onto the sheet material in the transfer zone 12, and the remaining 20% of the toner is removed from the image carrier member 6 in the cleaning zone 14. At the start of using the image-forming machine, in general, the developing agent container 28 is charged with carrier particles as well as a predetermined amount of the toner. Then, as the toner in the developing agent 68 in the developing agent container 28 is consumed, the developing agent container 28 is replenished with the toner that is fed into the mixing chamber 132 from the toner cartridge 144 that is newly and detachably mounted on the toner replenishing means 124. Therefore, a maximum theoretical amount of the toner present in the cleaning means 24, in the toner recycling means 26 and in the recycled toner receiving chamber 134 is 20% of the amount of the toner contained in the new toner cartridge 144, i.e., 20% of the capacity of the toner cartridge 144. Therefore, even in case the toner in the cleaning means 24 and in the toner recycling means 26 is substantially all fed into the recycled toner receiving chamber 134 under particular conditions, the maximum theoretical amount of the recycled toner to be contained in the recycled toner receiving chamber 134 is about 20% of the capacity of the toner cartridge 144. In view of the above-mentioned circumstances, when the capacity of the recycled toner receiving chamber 134 is set to be about 20% of the capacity of the toner cartridge 144, the recycled toner is reliably prevented from scattering around flowing over the recycled toner receiving chamber 134 without the need of greatly increasing the capacity of the recycled toner receiving chamber 134.

Moreover, attention should be given to the following fact in relation to the above-mentioned toner replenishing means 124. The new toner falls onto the mixing chamber 132 through the open upper surface thereof from the toner cartridge 144, and the recycled toner is fed thereinto through the open side surface thereof. By feeding the new toner and the recycled toner into the mixing chamber 132 in a particular manner as described above, it has been found that the new toner and the recycled toner can be mixed together very favorably in the mixing chamber 132. In addition, the recycled toner is effectively fed into the mixing chamber 132 by the action of the paddling piece 178 that is rotated in a direction indicated by arrow 173, i.e., rotated in a direction to move from the lower side to the upper side on the side facing the open side surface of the mixing chamber 132, contributing to promoting the mixing of the new toner and the recycled toner. It is possible to rotate the rotary shaft 172 on which the paddling piece 178 is formed, in a direction opposite to the direction indicated by arrow 173 (in this case, the direction of the spiral vane 174 formed on the rotary shaft 172 must be reversed). According to experiment conducted by the present inventors, however, it was found that rotating the paddling piece 178 in the direction indicated by arrow 173 is desirable from the standpoint of sending the recycled toner into the mixing chamber 132 and of mixing the new toner and the recycled toner together in the mixing chamber 132.

Controlling the Toner Replenishing Operation

As described already with reference to FIGS. 2 and 4, the developing means 20 includes the toner concentration detection means 66 which detects the toner concentration (i.e., ratio TW/DW of the weight DW of the developing agent 68 to the weight TW of the toner) in the developing agent 68 in the developing agent container 28. The toner concentration detection means 66 is constituted by a magnetic permeability detector known per se, which produces an output voltage which changes depending upon the toner concentration in the developing agent 68, or more specifically, which rises with a decrease in the toner concentration in the developing agent 68. The toner replenish control means 188 (FIG. 7) that can be constituted by a microcomputer controls the replenishing of toner into the developing agent container 28 or, more specifically, controls the operation of the electric motor 182 for replenishing the toner into the toner replenishing means 124 depending upon the toner concentration detected by the toner concentration detection means 66, i.e., depending upon the output voltage of the toner concentration detection means 66.

Figure 8:
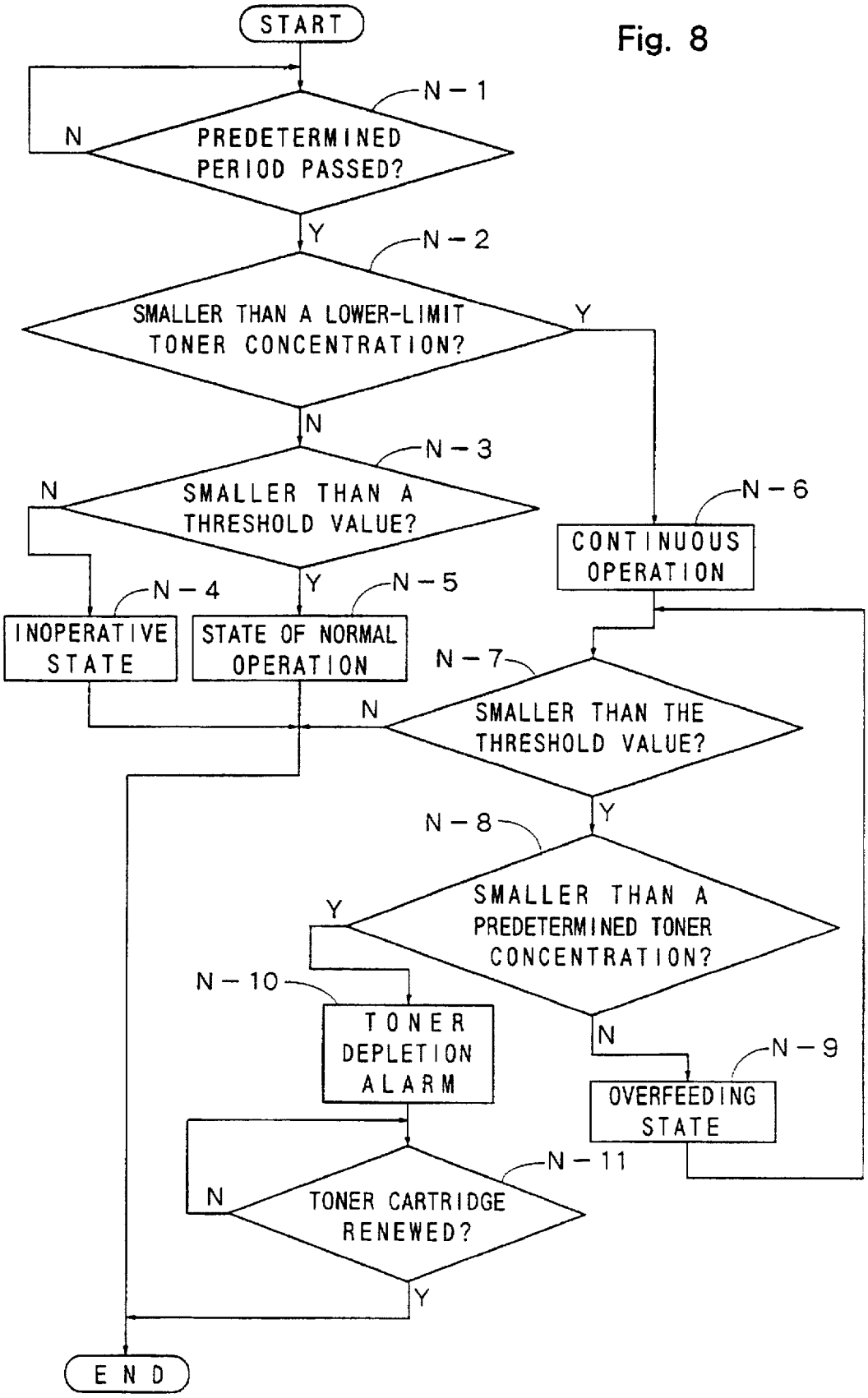
FIG. 8 is a flow chart explaining the toner replenishing control operation in the image-forming machine shown in FIG. 1.

With reference to the flow chart shown in FIG. 8, a step N-1 judges whether or not a predetermined period of time (e.g., five seconds) has passed after the main electric motor 184 is energized to drive the rotary drum 2, upstream-side conveyer/stirrer mechanism 52, downstream-side conveyer/stirrer mechanism 54 and recycled toner feeding means 170 in the developing means 20, to drive the toner conveyer means 152 in the cleaning means 24, and to drive the recycled toner conveyer means 166 in the toner recycling means 26. The program proceeds to a step N-2 after the passage of the predetermined period of time from the energization of the main electric motor 184. That is, when the main electric motor 184 is being deenergized, the toner is not replenished, and the operation for controlling the toner replenishing is started for the first time when the predetermined period of time has passed after the main electric motor 184 is energized. A step N-2 judges whether the toner concentration detected by the toner concentration detection means 66 is smaller than a predetermined lower-limit toner concentration (this lower-limit toner concentration will be described again later) or not (i.e., whether the output voltage of the toner concentration detection means 66 is larger than a predetermined upper-limit voltage that is set by an upper-limit voltage setting means 190 or not). When the toner concentration is greater than the lower-limit toner concentration, the program proceeds to a step N-3 where it is judged whether the toner concentration detected by the toner concentration detection means 66 is smaller than a predetermined threshold value (e.g., 3.6%) or not (i.e., whether the output voltage of the toner concentration detection means 66 is larger than a predetermined threshold voltage set by a threshold voltage setting means 192 or not). When the toner concentration is larger than the threshold value, the program proceeds to a step N-4 where the electric motor 182 for replenishing the toner that is in operation is rendered to be inoperative. Therefore, the developing agent container 28 is no longer replenished with the toner. When the toner concentration is smaller than the threshold value in the step N-3, the program proceeds to a step N-5 where the electric motor 182 for replenishing the toner is set to the state of normal operation. In the state of normal operation, the electric motor 182 for replenishing the toner is repetitively energized for only a normal feeding time T1 (e.g., one second) at a normal feeding interval T2 (e.g., one second) until the toner concentration detected by the toner concentration detection means 66 exceeds the threshold value. Therefore, the toner introduction means 180 is operated, and the developing agent container 28 is replenished with the toner from the mixing chamber 132.

When the toner concentration in the developing agent 68 in the developing agent container 28 abruptly decreases as a result of continuously developing many times the image having a relatively large so-called solid-black portion causing the toner concentration to become smaller than the lower-limit toner concentration (e.g., 2.5%) in the step N-2, the program then proceeds to a step N-6 where the electric motor 182 for replenishing the toner is continuously operated while inhibiting the start of the step of newly forming the image during this period. In this continuous operation, the electric motor 182 for replenishing the toner is continuously energized for only a predetermined continuously feeding time T3 (e.g., two minutes). Therefore, the toner introduction means 180 is continuously operated, and the developing agent container 28 is continuously replenished with the toner from the mixing chamber 132. The program then proceeds to a step N-7 where it is judged whether the toner concentration detected by the toner concentration detection means 66 is smaller than the threshold value or not. When the toner concentration is larger than the threshold value, the toner control routine is finished. When the toner concentration is smaller than the threshold value, however, the program proceeds to a step N-8 where it is judged whether or not the toner concentration detected by the toner concentration detection means 66 is smaller than a predetermined toner concentration (e.g., 3.2%) which is larger than the above-mentioned lower-limit toner concentration but is smaller than the above-mentioned threshold value (i.e., whether the output voltage of the toner concentration detection means 66 is larger than a predetermined voltage set by a predetermined voltage setting means 194). When the toner concentration is larger than this predetermined toner concentration, the program proceeds to a step N-9 where the electric motor 182 for replenishing the toner is set to an overfeeding state. In this overfeeding state, the electric motor 182 for replenishing the toner is repetitively energized for only an overfeeding time (e.g., two seconds) at an overfeeding interval T5 (e.g., one second) until the toner concentration detected by the toner concentration detection means 66 exceeds the threshold value. Accordingly, the toner introduction means 180 is operated and the toner is fed into the developing agent container 28. It is important that the overfeeding interval T5 is shorter than the normal feeding interval T2 and/or the overfeeding time T4 is longer than the normal feeding time T1, and that the toner is replenished in an excess amount during the overfeeding state compared with during the normal feeding state. In a case where as the toner is consumed, the toner may not exist in sufficient amounts in the mixing chamber 132 and even when the electric motor 182 for replenishing the toner is energized, the developing agent container 28 may not be replenished with the toner, the toner concentration detected by the toner concentration detection means 66 may become smaller than the predetermined toner concentration in the step N-8. In this case, the program proceeds to a step N-10 where the step for forming the image is inhibited from being continuously executed (but execution of the step for forming the image each time is allowed), and an alarm signal is formed to turn the alarm lamp on letting the user know the fact that the toner is depleted (i.e., letting the user know that the toner cartridge 144 must be renewed). The program then proceeds to a step N-11 where it is judged whether the toner cartridge 144 is renewed or not. Upon detecting a signal formed by the renewal of the toner cartridge 144, the toner replenish control routine is finished.

Attention should be given to the following fact in regard to controlling the above-mentioned toner replenishing operation. In the conventional toner replenish control operation, the steps N-8 and N-9 are not employed and, instead, the program proceeds directly to the step N-10 when the toner concentration is smaller than the threshold value in the step N-7. When the toner exists in sufficient amounts in the mixing chamber 132, therefore, the toner must be continuously fed in the step N-6 so that the toner concentration exceeds the threshold value and, hence, the continuously feeding time T3 must be set to be relatively long. In other words, the so-called waiting time becomes relatively long inhibiting the start of a step for newly forming the image. When the above-mentioned steps N-8 and N-9 are employed, on the other hand, it is allowed to set the continuously feeding time T3 in the step N-6 to a time which is necessary for recovering the toner concentration to a predetermined toner concentration lower than the threshold value, which is shorter than a time necessary for recovering the toner concentration to the threshold value. This helps shorten the so-called waiting time which inhibits the start of the step for newly forming the image. The predetermined toner concentration can be set to such a value which may not be an optimum toner concentration but which guarantees the execution of developing without any hindrance. When it is confirmed at the step N-8 that the toner concentration is exceeding the predetermined toner concentration, it is allowed to start the step for newly forming the image. In the step N-9, the toner is fed in an excess amount into the developing agent container compared with the case of the normal operation, and the toner concentration of the developing agent 68 in the developing agent container 28 is quickly recovered to the threshold value.

Compensating the Toner Replenish Control Threshold Value

In the illustrated image-forming machine, the toner removed from the image carrier member 6 in the cleaning zone 14 is reused being recycled into the developing means 20. When such a toner recycling mode is employed, as described already, an increase in the ratio of the recycled toner to the toner in the developing agent 68 in the developing agent container 28 with the repeated execution of the image-forming step brings about a change in a relationship between the output of the toner concentration detection means 66 and the practical toner concentration.

Figure 9:
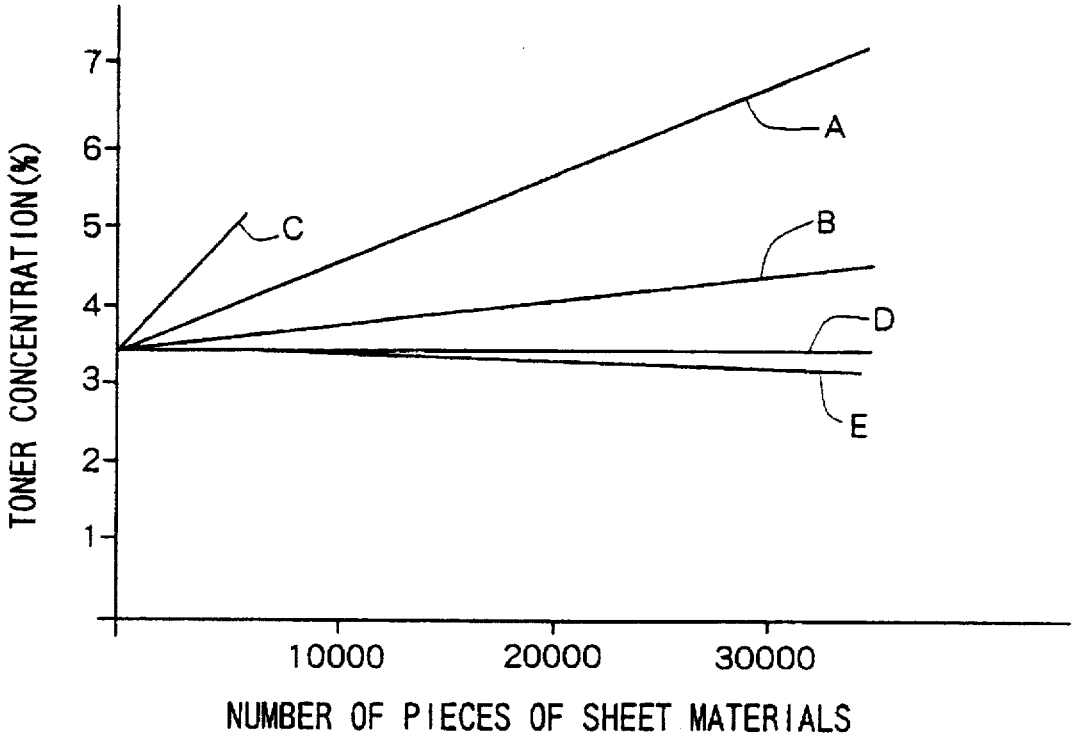
FIG. 9 is a diagram showing a relationship between the number of pieces of the sheet materials onto which the toner image is transferred and the toner concentration detected by a toner concentration detection means which is constituted by a magnetic permeability detector.

Described below is a change in the relationship between the output of the toner concentration detection means 66 and the practical toner concentration. FIG. 9 shows the results of experiment obtained by using an electrostatic copying machine placed in the market by Mita Industrial Co., Ltd. in the trade name of "DC-2256". The developing agent that is used is the one placed in the market by Mita Industrial Co., Ltd. in the trade name of "Developing agent for DC-2256" and comprises ferrite-type carrier particles having an average particle size of 105 μm and a styrene acrylic-type toner having an average particle size of 10 μm. The toner concentration detection means is a magnetic permeability detector placed in the market by Hitachi Metals, Ltd. in the trade name of "5-046A". In FIG. 9, the abscissa represents the number of pieces of the sheet materials onto which is transferred the toner image on the image carrier member 6 (i.e., represents the number of times of executing the step of image formation), and the ordinate represents the practical toner concentration of the developing agent in the developing agent container in the case where the toner replenishing control is executed with 3 V as a threshold value (i.e., where the replenishment of the toner is so adjusted that the output voltage of the magnetic permeability detector becomes 3 V). The practical toner concentration of the developing agent is found by picking up the developing agent in a required amount from the developing agent container and measuring the toner concentration in the picked-up developing agent. In FIG. 9, the line A represents the experimental results in the case where an ordinary copying machine is used in an average mode of use, i.e., used by repetitively executing a single-piece copying step for forming a piece of copy of an average document of a size A4 and a three consecutive-piece copying step for consecutively forming three pieces of copies of an average document of the size A4. The line B of FIG. 9 represents experimental results in the case where a continuously copying step is executed for continuously taking copies of an average document of the size A4 without interruption, and the line C of FIG. 9 represents experimental results in the case where a single-piece copying step is repetitively executed for taking copies of an average document of the size A4 piece by piece.

When the copying machine is used in an average mode of use as will be understood from FIG. 9, the practical toner concentration for the predetermined output voltage (3 V) of the magnetic permeability detector constituting the toner concentration detection means gradually increases with an increase in the ratio of the recycled toner to the toner in the developing agent with the execution of the step of image formation. When the step for consecutively taking copies only is executed, the practical toner concentration for the predetermined output voltage (3 V) of the magnetic permeability detector increases relatively gradually. When the step for taking a single piece of copy only is executed, the practical toner concentration for the predetermined output voltage (3 V) of the magnetic permeability detector increases very sharply. According to the study of the present inventors, the cause of difference in the increase of toner concentration is attributed as described below. When the step for taking a single copy is repetitively executed, the rotary drum rotates for a long period of time during periods of the step of not actually forming the image, i.e., the cumulative time of the so-called idle rotation of the rotary drum increases. During the period of such idle rotation, the toner is adhered in small amounts to the image carrier member in the developing zone, and the toner is removed from the image carrier member in the cleaning zone and is recycled into the developing means. When the step for taking a single copy is repetitively executed, therefore, the toner is recycled in an increased amount relative to the number of pieces of the formed copies, resulting in a very sharp increase in the practical toner concentration for the predetermined output voltage (3 V) of the magnetic permeability detector.

Figure 10:
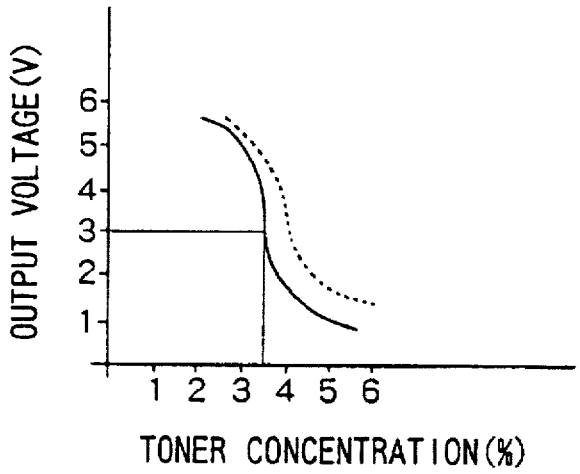
FIG. 10 is a diagram showing a relationship between the output voltage of the toner concentration detection means constituted by the magnetic permeability detector and the toner concentration.

FIG. 10 is a diagram illustrating relationships between the output voltage of the magnetic permeability detector and the toner concentration in the developing agent, wherein a solid line represents a relationship of when the toner in the developing agent is entirely the new toner without containing the recycled toner, and this relationship is that of after 10000 pieces of copies have been taken in the above-mentioned average mode of use.

In view of the above-mentioned facts confirmed by the present inventors through experiment, when the toner replenishing operation is controlled based upon the output voltage of the magnetic permeability detector constituting the toner concentration detection means 66 and the predetermined threshold voltage without effecting any particular compensation, the practical toner concentration of the developing agent 68 contained in the developing agent container 28 gradually increases with an increase in the number of times of executing the image-forming step. When the practical toner concentration of the developing agent 68 becomes excessively greater than the required value, the toner is electrically charged insufficiently. Accordingly, the absorptivity of the toner to the carrier particles decreases, giving rise to the occurrence of problems such as scattering of the toner in the developing zone 10, formation of the so-called fogging on the toner image (adhesion of toner to non-image portions), etc. According to the present invention, therefore, the threshold value used for controlling the toner replenishing is suitably changed depending upon the execution of the image-forming step. When the toner concentration detection means 66 is constituted by the magnetic permeability detector, as is understood from FIG. 9, the output voltage of the toner concentration detection means 66 for the predetermined toner concentration gradually increases with the execution of the image-forming step. Therefore, the threshold voltage set by the threshold voltage setting means 192 (FIG. 7) is gradually increased with the execution of the image-forming step. Theoretically, it is desired that the threshold voltage is so increased that the practical toner concentration of the developing agent 68 in the developing agent container 28 is maintained substantially constant irrespective of the number of times of executing the image-forming step as represented by a line D in FIG. 9. Or, the recycled toner is electrically charged less than the new toner and, hence, the electrically charging property of the toner decreases with an increase in the ratio of the recycled toner. In view of this fact, therefore, the practical toner concentration of the developing agent 68 in the developing agent container 28 gradually decreases with the execution of the image-forming step when the number of times of executing the image-forming step exceeds, for example, 6000 times as represented by a line E in FIG. 9. Accordingly, the threshold voltage may be so increased that the electrically charging property of the toner is maintained substantially constant.

According to experiment conducted by the present inventors, it has been found that when an ordinary copying machine is used in an average mode of use (a case represented by the line A in FIG. 9), there does not occur any problem even when the threshold voltage is not increased so far as the number of pieces of the sheet materials onto which the toner image is transferred (i.e., the number of times of executing the step of forming the image) is smaller than a predetermined number of pieces such as 6000 pieces. From the standpoint of facilitating the control operation, therefore, the threshold voltage may be maintained constant so far as the counted value of a counter means 196 (FIG. 7) that counts the number of pieces of sheet materials onto which the toner image is transferred is smaller than a predetermined value, e.g., smaller than 6000, and then, when the counted value of the counter means 196 exceeds the predetermined value, the threshold voltage may be increased by only a predetermined amount for every increase of the counted value by a predetermined amount, e.g., every time when the counted value is increased by 100. The amount of increase of the threshold voltage can be determined experimentally or empirically. The counting means 196 adds up the counted value every time when, for example, a sheet material detector disposed near the discharge port of the housing of the image-forming machine detects the sheet material that is discharged from the discharge port. As described with reference to lines A, B and C shown in FIG. 9, the relationship between the number of pieces of the sheet materials onto which the toner image is transferred and the change in the toner concentration varies to a considerable degree depending upon the mode of executing the copying step in the copying machine (i.e., depending upon a ratio of the execution of the step for taking a single piece of copy and the execution of the step for consecutively taking pieces of copies). Therefore, when it is anticipated that the copying machine may not be used in an average mode of use, the threshold voltage may be adjusted to increase relying upon the operation time of the main electric motor 186 (FIG. 7) that drives the rotary drum 2 (as well as the image carrier member 6 disposed on the surface thereof) in order to avoid or suppress the occurrence of error caused by a change in the mode of executing the copying step. In this case, the threshold voltage is maintained constant so far as, for example, a value of a time-counter means 198 (FIG. 7) that counts the cumulative operation time of the main electric motor 186 is smaller than a predetermined period of time, e.g., six hours (such a period of time nearly corresponds to the cumulative operation time of the main electric motor 186 required for an intermediate-speed copying machine to transfer the toner image into 6000 pieces of A4-size sheet materials in an average mode of use) and then after the value of the time-counter means 198 exceeds the predetermined period of time, the threshold voltage may be increased by only a predetermined amount every time when the counted value increases by a predetermined period of time, e.g., by 10 minutes.

As desired, furthermore, not only the threshold voltage set by the threshold voltage setting means 192 but also the upper-limit voltage set by the upper-limit voltage setting means 190 and the predetermined judging voltage set by the predetermined judging voltage setting means 194, may be suitably changed depending upon the value counted by the counter means 196 or the value counted by the counter means 198.

Though preferred embodiments of the image-forming machine constituted according to the present invention were described above in detail with reference to the accompanying drawings, it should be noted that the present invention is in no way limited to the above embodiments only but can be changed or modified in a variety of other ways without departing from the scope of the invention.

What we claim is:

1. An image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, a cleaning means for removing the toner remaining on said image carrier means after the toner image on said image carrier means has been transferred on to said sheet material, and a toner recycling means for recycling the toner removed from said image carrier means by said cleaning means into said developing means, wherein said developing means includes a developing agent container for containing a developing agent that comprises the toner and carrier particles, a developing agent application means for applying the developing agent in said developing agent container onto said image carrier means, a toner replenishing means for replenishing said developing agent container with the toner, a toner concentration detection means for detecting the toner concentration of the developing agent contained in said developing agent container, and a toner replenish control means for controlling the operation of said toner replenishing means by comparing a value detected by said toner concentration detection means with a threshold value, and wherein said toner concentration detection means is constituted by a magnetic permeability detector which produces an output voltage that varies depending upon the magnetic permeability of the developing agent in said developing agent container, the output voltage of said toner concentration detection means increasing with a decrease in the toner concentration of the developing agent in said developing agent container, said threshold value is a voltage, said toner replenish control means renders said toner replenishing means inoperative when the output voltage of said toner concentration detection means is smaller than said threshold value and renders said toner replenishing means to be operative when the output voltage of said toner concentration detection means exceeds said threshold value, and said toner replenish control means increases said threshold value with the execution of image formation.

2. An image-forming machine according to claim 1, wherein said image carrier means is constituted by an image carrier member that moves through an endless passage passing through a transfer zone and a cleaning zone, and an electric motor is disposed to move said image carrier member; and said toner replenish control means maintains said threshold value constant until the cumulative operation time of said electric motor exceeds a predetermined period of time and, when the cumulative operation time of said electric motor exceeds the predetermined period of time, increases said threshold value in proportion to an increase in the cumulative operation time of said electric motor.

3. An image-forming machine according to claim 1, wherein, said toner replenish control means maintains said threshold value constant until the number of pieces of the sheet materials onto which is transferred the toner image on said image carrier means exceeds a predetermined number of pieces and, when the number of pieces of the sheet materials onto which is transferred the toner image on said image carrier means exceeds the predetermined number of pieces, increases said threshold value in proportion to an increase in the number of pieces.

4. An image-forming machine according to claim 1, wherein said toner replenishing means includes a new toner container means for containing a new toner, a toner mixing chamber for mixing together the new toner fed from said new toner container means and the toner recycled by said toner recycling means, and a toner introduction means for introducing the toner in said mixing chamber into said developing agent container.

5. An image-forming machine according to claim 1, wherein in said developing agent container is disposed a conveyer/stirrer means that stirs the developing agent while conveying it through a circulation passage.

6. An image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, a cleaning means for removing the toner remaining on said image carrier means after the toner image on said image carrier means has been transferred onto said sheet material, and a toner recycling means for recycling the toner removed from said image carrier means by said cleaning means into said developing means, wherein said developing means includes a developing agent container for containing a developing agent that comprises the toner and carrier particles, a developing agent application means for applying the developing agent in said developing agent container onto said image carrier means, a toner replenishing means for replenishing said developing agent container with the toner, a toner concentration detection means for detecting the toner concentration of the developing agent contained in said developing agent container, and a toner replenish control means for controlling the operation of said toner replenishing means by comparing a value detected by said toner concentration detection means with a threshold value; and said toner replenishing means includes a new toner container means for containing a new toner, a recycled toner receiving chamber for receiving the toner recycled by said toner recycling means, a toner mixing chamber for mixing the new toner fed from said new toner container means and the toner fed from said recycled toner receiving chamber, a recycled toner feeding means for feeding the recycled toner in said recycled toner receiving chamber to said mixing chamber, and a toner introduction means for introducing the toner in said mixing chamber into said developing agent container, and wherein said mixing chamber has its upper surface, one side surface and front surface thereof opened;

said new toner container means is disposed over said mixing chamber and has a discharge port communicating with the upper open surface of said mixing chamber, so that the new toner in said new toner container means is permitted to fall on said mixing chamber through said discharge port;

said recycled toner feeding means feeds the recycled toner into said mixing chamber via said open one side surface of said mixing chamber; and said toner introduction means conveys the toner from said mixing chamber and introduces it into said developing agent container via said open front surface of said mixing chamber.

7. An image-forming machine according to claim 6, wherein said new toner container means is constituted by a toner cartridge that is detachably mounted.

8. An image-forming machine according to claim 6, wherein said recycled toner feeding means is constituted by a rotary shaft that extends along said open one side surface of said mixing chamber and paddling pieces disposed on the peripheral surface of said rotary shaft, said paddling pieces extending in the radial direction from the peripheral surface of said rotary shaft and further extending in the axial direction along the peripheral surface of said rotary shaft.

9. An image-forming machine according to claim 8, wherein said rotary shaft rotates in a direction in which front edges in the radial direction of said paddling pieces move from the lower position to the higher position on a side of said open one side surface of said mixing chamber.

10. An image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, a cleaning means for removing the toner remaining on said image carrier means after the toner image on said image carrier means has been transferred onto said sheet material, and a toner recycling means for recycling the toner removed from said image carrier means by said cleaning means into said developing means, wherein said developing means includes a developing agent container for containing a developing agent that comprises the toner and carrier particles, a developing agent application means for applying the developing agent in said developing agent container onto said image carrier means, a toner replenishing means for replenishing said developing agent container with the toner, a toner concentration detection means for detecting the toner concentration of the developing agent contained in said developing agent container, and a toner replenish control means for controlling the operation of said toner replenishing means by comparing a value detected by said toner concentration detection means with a threshold value; and said toner replenishing means includes a new toner container means for containing a new toner, a recycled toner receiving chamber for receiving the toner recycled by said toner recycling means, a toner mixing chamber for mixing the new toner fed from said new toner container means and the toner fed from said recycled toner receiving chamber, a recycled toner feeding means for feeding the recycled toner in said recycled toner receiving chamber to said mixing chamber, and a toner introduction means for introducing the toner in said mixing chamber into said developing agent container, and wherein the capacity of said recycled toner receiving chamber is set to be about 20% of the capacity of said new toner container means.

11. An image-forming machine according to claim 10, wherein said new toner container means is constituted by a toner cartridge that is detachably mounted.

12. An image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto said sheet material, wherein said developing means includes a developing agent container for containing a developing agent that comprises the toner and carrier particles, a developing agent application means for applying the developing agent in said developing agent container onto said image carrier means, a toner replenishing means for replenishing said developing agent container with the toner, a toner concentration detection means for detecting the toner concentration of the developing agent contained in said developing agent container, and a toner replenish control means for controlling the operation of said toner replenishing means by comparing a value detected by said toner concentration detection means with a threshold value; and said toner replenishing means includes an electric motor for replenishing the toner so that when said electric motor for replenishing the toner is energized, said developing agent container is replenished with the toner;

said toner replenish control means renders said toner replenishing means to be inoperative when a value detected by said toner concentration detection means is larger than the toner concentration represented by said threshold value, renders said toner replenishing means to be operative when a value detected by said toner concentration detection means becomes smaller than the toner concentration represented by said threshold value, and repetitively operates said electric motor for replenishing the toner for only a normal feeding time T1 at a normal feeding interval T2 under the operating condition, and wherein when the toner concentration represented by a value detected by said toner concentration detection means becomes smaller than a predetermined lower-limit toner concentration which is smaller than the toner concentration represented by said threshold value, said toner replenish control means continuously energizes the motor for replenishing the toner of said toner replenishing means for only a continuously feeding time T3 which is longer than said normal feeding time T1, and when the toner concentration represented by a value detected by said toner concentration detection means is in excess of a predetermined judging toner concentration which is smaller than the toner concentration represented by said threshold value but is larger than said lower-limit toner concentration value after the passage of said continuously feeding time T3, said toner replenish control means renders said toner replenishing means to be placed under an overfeeding operation condition and under this overfeeding operation condition, said electric motor for feeding the toner is repetitively energized for only an overfeeding time T4 which is longer than said normal feeding time T1 but is shorter than said continuously feeding time T3 at an overfeeding interval T5.

13. An image-forming machine according to claim 12, wherein said overfeeding time T4 is about twice as long as the normal feeding time T1, and said overfeeding interval T5 is nearly as long as the normal feeding interval T3.

14. An image-forming machine according to claim 12, wherein said continuously feeding time T3 is more than 60 times as long as said normal feeding time T1.

15. An image-forming machine according to claim 12, wherein when the toner concentration represented by a value detected by said toner concentration detection means is smaller than said predetermined toner concentration after the motor for replenishing the toner in said toner replenishing means has been continuously energized for only said continuously feeding time T3, said toner replenish control means forms a toner depletion signal that represents the depletion of toner in the toner replenishing means.

16. An image-forming machine according to claim 12, wherein said toner concentration detection means is constituted by a magnetic permeability detector which produces an output voltage that varies depending upon the magnetic permeability of the developing agent in said developing agent container, and the output voltage of said toner concentration detection means increases with a decrease in the toner concentration in the developing agent in the developing agent container.

17. An image-forming machine according to claim 13, further comprising a toner recycling means for recycling into said developing means the toner that is removed from said image carrier means by said cleaning means, wherein said toner replenish control means changes said normal feeding time T1 and/or said normal feeding interval T2 with the execution of image formation.

18. An image-forming machine according to claim 17, wherein said image carrier means is constituted by an image carrier member that moves through an endless passage passing through a transfer zone and a cleaning zone, and an electric motor is disposed to move said image carrier member; and said toner replenish control means maintains said normal feeding time T1 and said normal feeding interval T2 constant until the cumulative operation time of said electric motor exceeds a predetermined period of time and, when the cumulative operation time of said electric motor exceeds the predetermined period of time, shortens said normal feeding time T1 and/or lengthens said normal feeding interval T2.

19. An image-forming machine according to claim 17, wherein, said toner replenish control means maintains said normal feeding time T1 and said normal feeding interval T2 constant until the number of pieces of the sheet materials onto which is transferred the toner image on said image carrier means exceeds a predetermined number of pieces and, when the number of pieces of the sheet materials onto which is transferred the toner image on said image carrier means exceeds the predetermined number of pieces, shortens said normal feeding time T1 and/or lengthens said normal feeding interval T2.

20. An image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto said sheet material, wherein said developing means includes a developing agent container for containing a developing agent that comprises the toner and carrier particles, a developing agent application means for applying the developing agent in said developing agent container onto said image carrier means, and a conveyer/stirrer means disposed in said developing agent container;

in said developing agent container is defined a circulation passage constituted by an upstream-side passage and a downstream-side passage that extend in parallel in the direction of width, said upstream-side passage and said downstream-side passage being in communication with each other at both ends thereof in the direction of width;

said conveyer/stirrer means includes an upstream-side conveyer/stirrer mechanism disposed in said upstream-side passage and a downstream-side conveyer/stirrer mechanism disposed in said downstream-side passage, said upstream-side conveyer/stirrer mechanism being constituted by a rotary shaft that extends through said upstream-side circulation passage in the direction of width and by a spiral vane disposed on the peripheral surface of said rotary shaft, and said downstream-side conveyer/stirrer mechanism being constituted by a rotary shaft that extends through said downstream-side circulation passage in the direction of width and by a spiral vane disposed on the peripheral surface of said rotary shaft: and said developing agent application means includes a sleeve member that extends along said downstream-side passage in the direction of width, and draws up the developing agent present in said downstream-side passage onto the peripheral surface of said sleeve member to apply it onto said image carrier means, and wherein said downstream-side conveyer/stirrer mechanism includes a number of paddling pieces disposed on the peripheral surface of said rotary shaft at a distance in the peripheral direction, each of said paddling pieces extending in the radial direction from the peripheral surface of said rotary shaft and substantially straight in the axial direction across said spiral vane, and the front edges in the radial direction of said paddling pieces being located on the inside of the outer peripheral edges of said spiral vane in the radial direction.

21. An image-forming machine according to claim 20, wherein said downstream-side conveyer/stirrer mechanism has the paddling pieces that are disposed substantially uniformly over substantially the whole developing operation region of said sleeve material, each of said paddling pieces continuously extending in the axial direction across said spiral vane.

22. An image-forming machine according to claim 20, wherein said upstream-side conveyer/stirrer mechanism includes a number of paddling pieces disposed on the peripheral surface of said rotary shaft at a distance in the peripheral direction, each of said paddling pieces extending in the radial direction from the peripheral surface of said rotary shaft and further extending in the axial direction across said spiral vane, and the front edges in the radial direction of said paddling pieces being located on the inside of the outer peripheral edge of said spiral vane in the radial direction.

23. An image-forming machine according to claim 22, wherein said upstream-side conveyer/stirrer mechanism has no paddling piece in intermediate regions across the spiral vane in the axial direction in at least a portion of the rotary shaft.

24. An image-forming machine according to claim 20, wherein the length from the peripheral surface of the rotary shaft to the front edge of said paddle piece in the radial direction is nearly one half the length from the peripheral surface of the rotary shaft to the outer peripheral edge of the spiral vane in the radial direction.

25. An image-forming machine according to claim 20, wherein said developing means comprises a toner feeding means for feeding the toner into the developing agent container, said toner feeding means introduces the toner onto a side end portion in the direction of width of said upstream-side passage, said upstream-side conveyer/stirrer mechanism conveys the developing agent from said one end portion to the other end portion within said upstream-side passage, and said downstream-side conveyer/stirrer mechanism conveys the developing agent within said downstream-side passage in a direction opposite to the direction in which the developing agent is conveyed in said upstream-side passage;

and said upstream-side conveyer/stirrer mechanism has said paddling pieces that are disposed more densely on said one end portion thereof and on the vicinities thereof than on the other end portion and on the vicinities thereof.

26. An image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto said sheet material, wherein said developing means includes a developing agent container for containing a developing agent that comprises the toner and carrier particles, a developing agent application means for applying the developing agent in said developing agent container onto said image carrier means, and a conveyer/stirrer means disposed in said developing agent container;

in said developing agent container is defined a circulation passage constituted by an upstream-side passage and a downstream-side passage that extend in parallel in the direction of width, said upstream-side passage and said downstream-side passage being in communication with each other at both ends thereof in the direction of width;

said conveyer/stirrer means includes an upstream-side conveyer/stirrer mechanism disposed in said upstream-side passage and a downstream-side conveyer/stirrer mechanism disposed in said downstream-side passage, said upstream-side conveyer/stirrer mechanism being constituted by a rotary shaft that extends through said upstream-side circulation passage in the direction of width and by a spiral vane disposed on the peripheral surface of said rotary shaft, and said downstream-side conveyer/stirrer mechanism being constituted by a rotary shaft that extends through said downstream-side circulation passage in the direction of width and by a spiral vane disposed on the peripheral surface of said rotary shaft; and said developing agent application means includes a sleeve member that extends along said downstream-side passage in the direction of width, and draws up the developing agent present in said downstream-side passage onto the peripheral surface of said sleeve member to apply it onto said image carrier means, and wherein said upstream-side conveyer/stirrer mechanism includes a number of paddling pieces disposed on the peripheral surface of said rotary shaft at a distance in the peripheral direction, each of said paddling pieces extending in the radial direction from the peripheral surface of said rotary shaft and substantially straight in the axial direction across said spiral vane, and the front edges in the radial direction of said paddling pieces being located on the inside of the outer peripheral edge of said spiral vane in the radial direction.

27. An image-forming machine according to claim 26, wherein said upstream-side conveyer/stirrer mechanism has no paddling piece in intermediate regions across the spiral vane in the axial direction in at least a portion of the rotary shaft.

28. An image-forming machine according to claim 26, wherein the length from the peripheral surface of the rotary shaft to the front edge of said paddling piece in the radial direction is nearly one half the length from the peripheral surface of the rotary shaft to the outer peripheral edge of the spiral vane in the radial direction.

29. An image-forming machine according to claim 26, wherein said developing means comprises a toner feeding means for feeding the toner into the developing agent container, said toner feeding means introduces the toner onto a side end portion in the direction of width of said upstream-side passage, said upstream-side conveyer/stirrer mechanism conveys the developing agent from said one end portion to the other end portion within said upstream-side passage, and said downstream-side conveyer/stirrer mechanism conveys the developing agent within said downstream-side passage in a direction opposite to the direction in which the developing agent is conveyed in said upstream-side passage; and said upstream-side conveyer/stirrer mechanism has said paddling pieces that are disposed more densely on said one end portion thereof and on the vicinities thereof than on the other end portion and on the vicinities thereof.

30. An image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto said sheet material, wherein said developing means includes a developing agent container for containing a developing agent that comprises the toner and carrier particles, a developing agent application means having a sleeve member for applying the developing agent in said developing agent container onto said image carrier means, and a developing agent limiting member; wherein said sleeve member is rotated in a predetermined direction to hold the developing agent in said developing agent container on the peripheral surface thereof in a developing agent drawing-up zone to carry it onto a developing operation zone, and said developing agent limiting member is positioned close to the peripheral surface of said sleeve member between said developing agent drawing-up zone and said developing operation zone in order to limit the amount of the developing agent held on the peripheral surface of said sleeve member, which is characterized in that a uniformalizing member is disposed on the upstream side of said developing agent limiting member as viewed in a direction in which said sleeve member rotates, said uniformalizing member having a working surface that gradually approaches the peripheral surface of said sleeve member toward the downstream side as viewed in a direction in which the sleeve member rotates, and a gap between the downstream end edge of said working surface of said uniformalizing member and the peripheral surface of said sleeve member being set to be larger than a gap between said developing agent limiting member and the peripheral surface of said sleeve member but smaller than the thickness of the layer of the developing agent held on the peripheral surface of said sleeve member in said developing agent drawing-up zone.

31. An image-forming machine according to claim 30, wherein the gap between said developing agent limiting member and the peripheral surface of said sleeve member is from 0.3 to 0.8 mm, and the gap between the downstream end edge of the working surface of said uniformalizing member and the peripheral surface of said sleeve member is from 1.0 to 3.0 mm.

32. An image-forming machine according to claim 30, wherein said working surface of said uniformalizing member extends being inclined at an angle of from 20 to 30 degrees with respect to a tangential line at a portion where the peripheral surface of said sleeve member is opposed to the downstream end edge of said uniformalizing member.

33. An image-forming machine comprising an image carrier means, an electrostatic latent image-forming means for forming an electrostatic latent image on said image carrier means, a developing means for developing the electrostatic latent image on said image carrier means into a toner image, a transfer means for transferring the toner image on said image carrier means onto a sheet material, and a cleaning means for removing the toner remaining on said image carrier means after the toner image on said image carrier means has been transferred onto said sheet material, wherein said developing means includes a developing agent container for containing a developing agent that comprises the toner and carrier particles, a developing agent application means having a sleeve member for applying the developing agent in said developing agent container onto said image carrier means, and stationary sealing members that arcuately extend at both ends of said sleeve member along said sleeve member, said sleeve member being rotated in a predetermined direction to hold the developing agent in said developing agent container on the peripheral surface thereof in a developing agent drawing-up zone and to convey it onto a developing operation zone, and wherein at least inside portions in the direction of width at upstream end edges of said sealing members as viewed in a direction in which said sleeve member rotates are downwardly extending toward the inside in the direction of width.

34. An image-forming machine according to claim 33, wherein said sealing members are constituted by a felt.

* * * * *